US011117343B2

(12) United States Patent
Schultz

(10) Patent No.: US 11,117,343 B2
(45) Date of Patent: Sep. 14, 2021

(54) SYSTEM AND METHOD FOR CUTTING STRAWS

(71) Applicant: Hoffmaster Group, Inc., Oshkosh, WI (US)

(72) Inventor: Jerome P. Schultz, Fort Wayne, IN (US)

(73) Assignee: Hoffmaster Group, Inc., Oshkosh, WI (US)

( * ) Notice: Subject to any disclaimer, the term of this patent is extended or adjusted under 35 U.S.C. 154(b) by 20 days.

(21) Appl. No.: 16/541,906

(22) Filed: Aug. 15, 2019

(65) Prior Publication Data

US 2021/0046724 A1 Feb. 18, 2021

(51) Int. Cl.
*B31D 5/00* (2017.01)

(52) U.S. Cl.
CPC ..... *B31D 5/0095* (2013.01)

(58) Field of Classification Search
CPC ..... B31D 5/0095; B26D 1/60; B26D 1/605; B26D 3/16; Y10T 83/464; Y10T 83/472; Y10T 83/4722; Y10T 83/4725; Y10T 83/9292; Y10T 83/4789; Y10T 83/4795
USPC ..... 493/288; 83/318, 319, 320
See application file for complete search history.

(56) References Cited

U.S. PATENT DOCUMENTS 700,662 A 5/1902 Koffler
1,210,895 A 1/1917 Brinkman
1,242,478 A * 10/1917 Rosewarne ..... A24C 5/28 83/310
1,843,395 A 2/1932 Lauterback
1,860,989 A 5/1932 Brinkman
1,954,881 A 7/1934 List
2,002,896 A 5/1935 Kopetz
2,093,155 A 9/1937 Muller
2,094,268 A 9/1937 Joseph
2,631,645 A 9/1937 Friedman
2,390,533 A 12/1945 Hill
2,550,797 A 5/1951 Friedman
(Continued)

OTHER PUBLICATIONS

"Eco-Flex: Innovation by Design". Found online Mar. 11, 2016 at aardvarkstraws.com. Page dated Apr. 12, 2015 Retrieved from http:1/web.archive.org/web/2015041208505 8/http://www.aardvarkstraws.com/eco-fiex/.
(Continued)

*Primary Examiner* — Chelsea E Stinson
(74) *Attorney, Agent, or Firm* — Shane Delsman; Godfrey & Kahn, S.C.

(57) ABSTRACT

A system and method for cutting straws. The system includes a cutting device. The cutting device may include a cutting device frame, a tubing guide connected to the cutting device frame for receiving tubing and guiding the tubing into a position to be cut, and a blade spool having a spool central axis. The blade spool may include a spool frame, connected to the cutting device frame, and a blade assembly. The spool frame may rotate with respect to the cutting device frame about the spool central axis. The blade assembly may include a blade shaft connected to the spool frame and a blade connected to the blade shaft. The blade may rotate about the blade shaft central axis and move through the tubing when the tubing is in the position to be cut. In another embodiment, the system may include a winding device and a control monitor.

10 Claims, 33 Drawing Sheets

(56) References Cited

U.S. PATENT DOCUMENTS

| | | | | |
|---|---|---|---|---|
| 2,985,077 | A | 5/1961 | Strahammer et al. | |
| 3,012,604 | A | 12/1961 | Zieg | |
| 3,025,004 | A | 3/1962 | Levi | |
| 3,122,977 | A | 3/1964 | Graham | |
| 3,242,828 | A | 3/1966 | Larkin | |
| 3,346,187 | A | 10/1967 | Mueller | |
| D209,382 | S | 11/1967 | Nardone | |
| D211,226 | S | 5/1968 | Nardone | |
| 3,409,224 | A | 11/1968 | Harp et al. | |
| 3,438,578 | A | 4/1969 | Peterson et al. | |
| 3,641,884 | A | 2/1972 | Jivoin | |
| 4,216,801 | A | 8/1980 | Aykanian | |
| 4,370,140 | A * | 1/1983 | Fegley | B26D 1/60 493/289 |
| D275,542 | S | 9/1984 | Hacke | |
| 4,613,474 | A | 9/1986 | Donati | |
| 5,158,532 | A | 10/1992 | Peng et al. | |
| D561,282 | S | 2/2008 | Rollinson | |
| D589,694 | S | 4/2009 | Guers-Neyraud | |
| 8,181,816 | B2 | 5/2012 | Allen | |
| 8,540,926 | B2 | 9/2013 | Crawley | |
| D699,997 | S | 2/2014 | Van Der Lande | |
| D757,476 | S | 5/2016 | O'Neill | |
| 9,974,403 | B1 | 5/2018 | O'Neill | |
| 2003/0134254 | A1 | 7/2003 | Filho | |
| 2005/0087619 | A1 | 4/2005 | Nasr | |
| 2008/0023567 | A1 | 1/2008 | Byerly | |
| 2015/0190004 | A1 | 7/2015 | Chang et al. | |

OTHER PUBLICATIONS

"Norpro 428 50-Pack Flexible Straws, Multicolored". Found online Mar. 11, 2016 amazon.com. Page dated Sep. 7, 2012. Retrieved from http://www.amazon.com/Norpro-428-50-Pack-Flexible-Multicolored/dp/BOOOSSVBXE.

"Prirnastraw.Primaplastindonesia". Found online Mar. 11, 2016 at primastraw com. Page dated c. 2011. Retrieved from http://www.primastraw .com/products/ flexible-straw/.

* cited by examiner

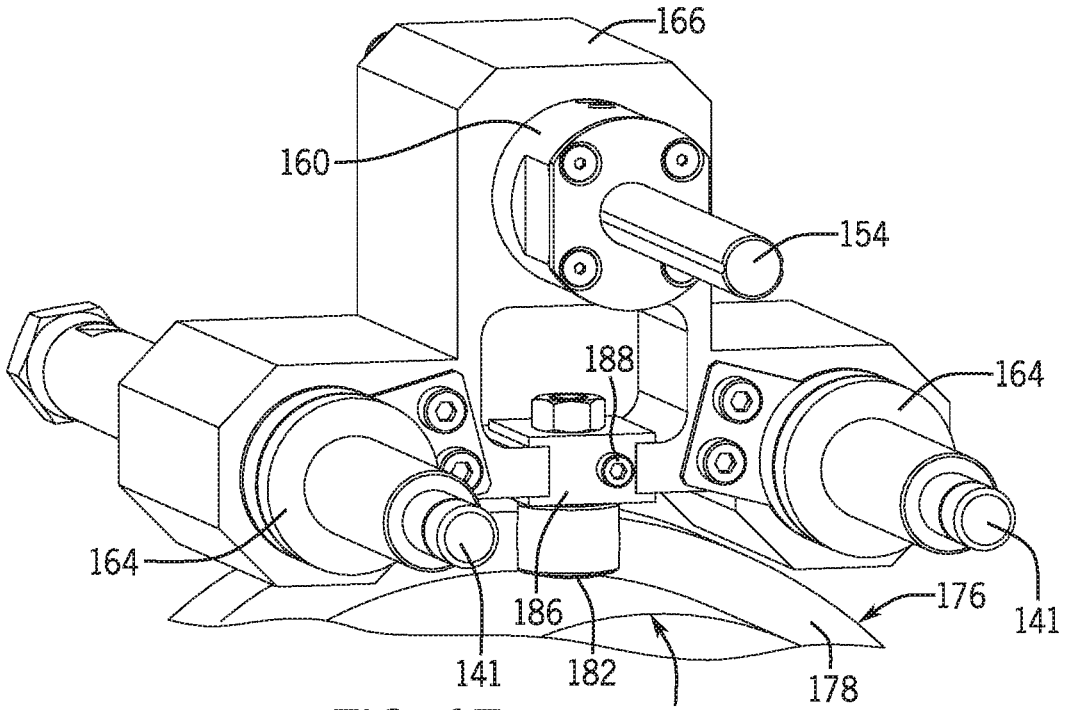
FIG. 17
FIG. 18
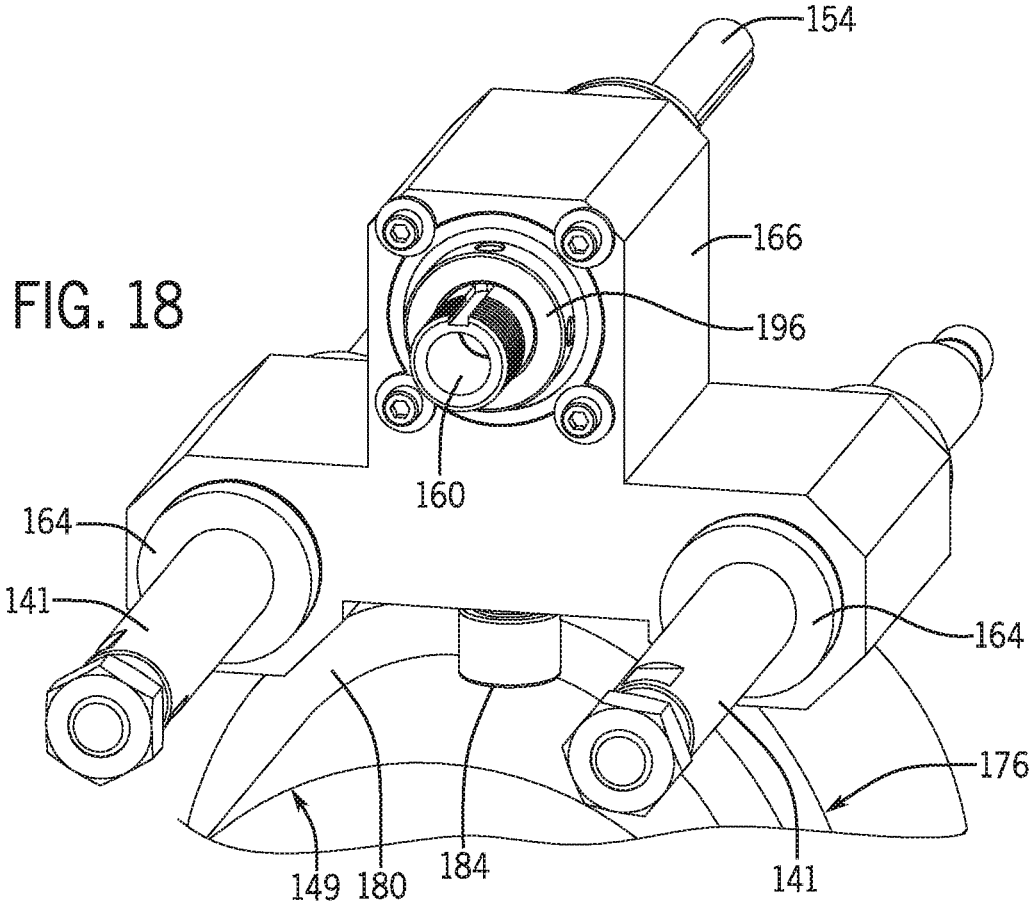

SYSTEM AND METHOD FOR CUTTING STRAWS

FIELD

This invention relates to the manufacture of straws, and in particular to a system and method for cutting straws, such as drinking straws, stir straws, and the like.

BACKGROUND

The process of creating a straw, such as a drinking straw, cocktail straw, stir straw, etc., often involves cutting straws of a desired straw length from an elongated section of tubing. For manufacturers of large quantities of straws, it may be necessary to complete such a cutting process with regard to a significant number of straws in a short time span. Hence, a system and method that can accomplish this cutting process in a timely and efficient manner may be beneficial to such manufacturers. It may also be beneficial for such a system and method to produce clean cuts at the longitudinal ends of each completed straw. Clean cut straw ends may have a greater visual appeal to purchaser and may also more strongly appeal to a user's touch when the user opens or holds the straw, or, in terms of a drinking straw, when the user drinks from the straw.

BRIEF SUMMARY OF THE INVENTION

In certain aspects, the present invention provides a system and method for cutting straws. In accordance with some forms of the invention, such system and method are configured to revolve a movable blade connected to a rotating spool through a tubing when the tubing is in a apposition to be cut. Accordingly, in one embodiment, the present invention provides a device for cutting straws comprising a cutting device frame, a tubing guide connected to the cutting device frame and configured to receive tubing and guide the tubing into a position to be cut, and a blade spool having a spool central axis. The blade spool includes a spool frame connected to the cutting device frame, and a blade assembly. The spool frame is configured to rotate with respect to the cutting device frame about the spool central axis. The blade assembly includes a blade shaft connected to the spool frame and a blade connected to the blade shaft. The blade is configured to rotate about the blade shaft central axis and to move through the tubing when the tubing is in the position to be cut.

In another embodiment, the invention provides a system for cutting straws comprising a winding device configured to wind a material into tubing and a cutting device. The cutting device comprises a cutting device frame, a tubing guide, and a blade spool having a spool central axis. The tubing guide is connected to the cutting device frame and configured to receive the tubing and guide the tubing into a position to be cut. The blade spool comprises a spool frame connected to the cutting device frame, a blade shaft connected to the spool frame and having a blade shaft central axis, and a blade connected to the blade shaft. The spool frame is configured to rotate with respect to the cutting device frame about the spool central axis. The blade shaft is positioned such that the blade shaft central axis is spaced apart from and parallel to the spool central axis. The blade is configured to rotate about the blade shaft central axis.

In a further embodiment, the invention provides a device for cutting paper straws comprising a frame, a tubing guide connected to and positioned at least in part within the frame, the tubing guide configured to receive tubing and guide the tubing into a position to be cut, a fixed axle secured to and positioned at least in part within the frame, a barrel cam mounted to the fixed axle, and a blade spool connected to and positioned at least in part within the frame. The barrel cam has a rib including a first rib face and an opposing second rib face. The blade spool comprises a first spool sidewall, a second spool sidewall, a plurality of guide rods connecting the first spool sidewall to the second spool sidewall, and a blade assembly. The first spool sidewall and the second spool sidewall are each normally and rotatably connected to the fixed axle, and the second spool sidewall is spaced apart from the first spool sidewall. The first spool sidewall further comprises a spool driven pulley configured to rotate the blade spool about the fixed axle. The blade assembly comprises a blade shaft having a blade shaft central axis, the blade shaft normally connected to the second spool sidewall, a blade shaft driven pulley connected to and configured to rotate the blade shaft about the blade shaft central axis, a spindle slidably connected to the blade shaft in a manner fixed against rotation with respect to the blade shaft, a first bushing slidably connected to one of the plurality of guide rods, a blade carriage connected to the first bushing and to the spindle in a manner that permits free rotation of the spindle with respect to the blade carriage, a blade mounted to the spindle in a manner fixed against rotation with respect to the spindle, a first cam follower connected to the blade carriage in a manner such that the first cam follower is free to rotate with respect to the blade carriage, and a second cam follower connected to the blade carriage in a manner such that the second cam follower is free to rotate with respect to the blade carriage. The first cam follower is positioned, at least in part, in contact with the first rib face, and the second cam follower is positioned, at least in part, in contact with the second rib face. The device further comprises a first timing belt secured about at least the spool driven pulley, a first driving pulley spaced apart from the spool driven pulley and configured to apply a first force to the first timing belt sufficient to rotate the spool driven pulley, a servo motor connected to and configured to rotate the first driving pulley, a second timing belt secured about at least the blade shaft driven pulley, a second driving pulley spaced apart from the blade shaft driven pulley and configured to apply a second force to the second timing belt sufficient to rotate the blade shaft driven pulley, and a blade drive motor connected to and configured to rotate the second driving pulley.

In another embodiment, the invention provides a method for cutting straws comprising moving tubing in a direction through a cutting device, rotating a first blade about a first blade central axis, and revolving the first blade central axis about a parallel axis spaced apart from the first blade central axis while the first blade rotates about the first blade central axis, such that the first blade moves through the tubing when the tubing is in a first position to be cut.

In a further embodiment, the invention provides a method for cutting straw comprising winding a material into tubing, transferring the tubing to a cutting device, guiding the tubing in a direction through the cutting device into a position to be cut, rotating a blade about a blade central axis, revolving the blade central axis about a parallel axis spaced apart from the blade central axis, and moving the rotating blade through the tubing when the tubing is in the position to be cut.

In a further embodiment still, the invention provides a method for cutting paper straws comprising moving tubing in a direction through a cutting device, rotating a first blade about a first blade central axis, revolving the first blade central axis about a parallel axis spaced apart from the first blade central axis while the first blade rotates about the first blade central axis, such that the first blade moves through the tubing when the tubing is in a first position to be cut, and sliding the first blade in a direction coinciding with the direction in which the tubing moves through the cutting device when the first blade is moving through the tubing. The method further comprises rotating a second blade having a second blade central axis parallel to and spaced apart from the parallel axis about the second blade central axis, revolving the second blade central axis about the parallel axis while the second blade rotates about the second blade central axis, such that the second blade moves through the tubing when the tubing is in a second position to be cut, and sliding the second blade in a direction coinciding with the direction in which the tubing moves through the cutting device when the second blade is moving through the tubing.

Other objects and advantages of the present disclosure will become apparent hereinafter.

BRIEF DESCRIPTION OF THE DRAWINGS

Embodiments of the system and method for cutting straws are disclosed with reference to the accompanying exemplary drawings, which are for illustrative purposes. Various portions or components of the system may be omitted from illustration in one or more FIGS. to improve clarity or to provide a view of underlying components. Neither the system, nor the method, for cutting straws is limited in application to the details of construction or the arrangement of the components illustrated in the drawings. The system and method for cutting straws are capable of other embodiments or of being practiced or carried out in various other ways. In the drawings:

FIG. 17 is a top perspective view of a blade carriage and related components of the cutting device shown in FIG. 1, viewed from the left side, with some elements removed and part of the cam cut away for clarity.

FIG. 18 is a top perspective view of the blade carriage and related components of the cutting device shown in FIG. 1, viewed from the right side, with some elements removed and part of the cam cut away for clarity.

DETAILED DESCRIPTION

Figures 1, 1A:
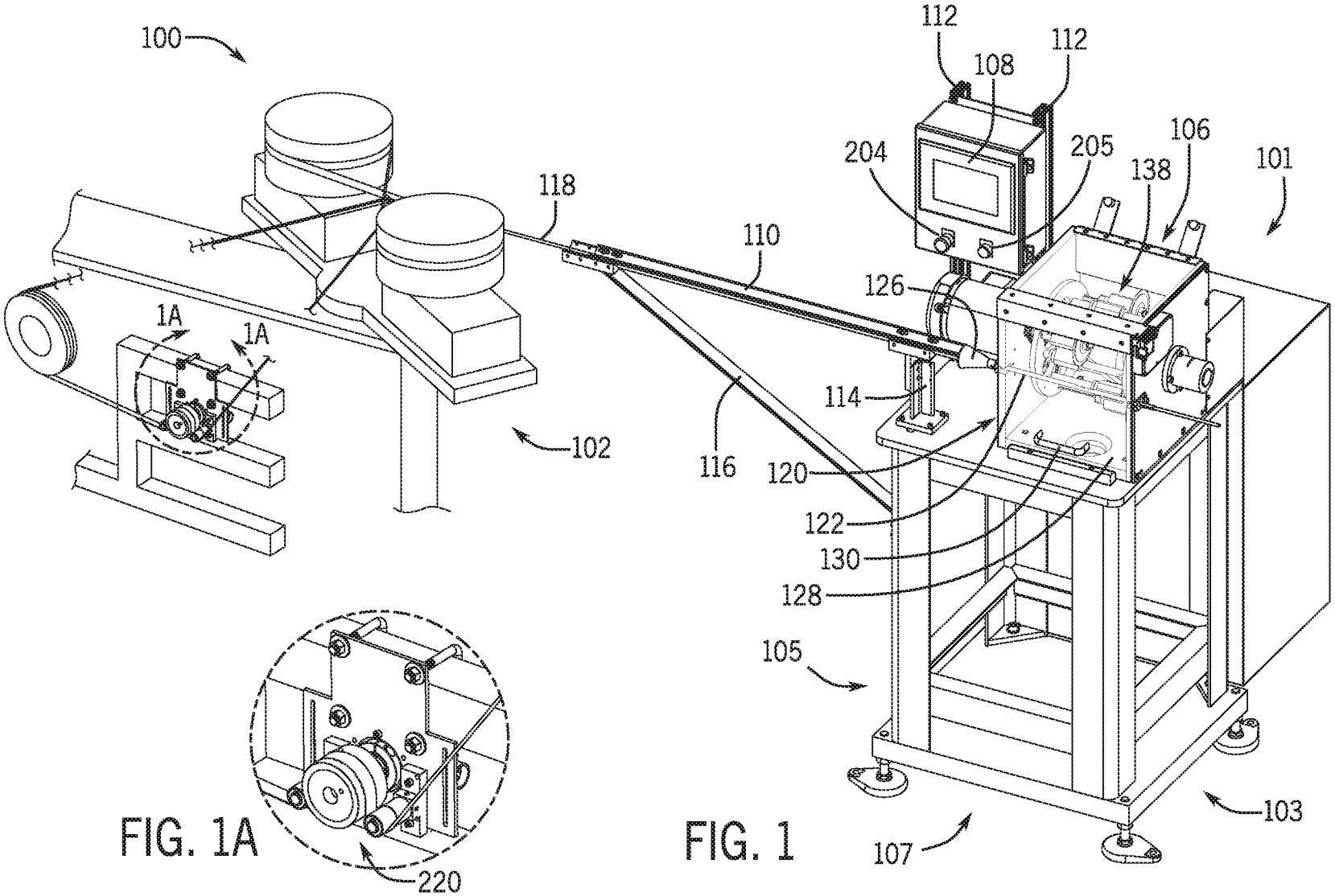
FIG. 1 is a top perspective view of a system for cutting straws, according to one embodiment of the present disclosure, including a winding device, a control monitor, an encoder, and a cutting device.
FIG. 1A is an enlarged detail view of the encoder shown in FIG. 1.

FIGS. 1-20 show a first embodiment of a system 100 for cutting straws. Referring to FIGS. 1-4, multiple perspective and elevation views of a system 100 are provided, as described above. For reference, a rear 101, a right side 103, a left side 105, and a front 107 are identified in FIG. 1.

In the embodiment shown in FIGS. 1-4, the system 100 includes a winding device 102, a support structure 104, a cutting device 106, a control monitor 108, an angle guide 110, and an encoder 220. In the present embodiment, the cutting device 106 is directly mounted to the support structure 104. The control monitor 108 is mounted to the support structure 104 by a pair of monitor support members 112, and the angle guide 110 is mounted to the support structure 104 by a first angle guide support 114 and a second angle guide support 116. In alternative embodiments, alternative means of supporting the cutting device 106, control monitor 108, and angle guide 110 may be permissible. In the present embodiment, the angle guide 110 is sized to guide a tubing 118, formed from strips of material by the winding device 102, to the cutting device 106. In some embodiments, the material of the tubing 118 is paper.

In this embodiment, the cutting device 106 includes a frame 120 and a tubing guide 122 protruding through the frame 120 and connected to the frame 120 by tubing guide clamps 124. Attached to the tubing guide 122 and positioned adjacent to the angle guide 110 is a funnel 126 sized to receive the tubing 118 and transfer the tubing 118 from the angle guide 110 to the tubing guide 122. In the present embodiment, the funnel 126 and the tubing guide 122 are sized to receive jumbo drinking straw tubing, having a diameter of approximately ¼ inch. However, in other embodiments, other funnel and tubing guide sizes may be employed to accommodate alternatively sized tubing. For instance, in alternative embodiments, a funnel and tubing guide may be utilized that are sized to receive giant drinking straw tubing, having a diameter of approximately 5/16 inch, colossal drinking straw tubing, having a diameter of approximately 7/16 inch, boba drinking straw tubing, having a diameter of approximately ½ inch, cocktail straw tubing, having a diameter of approximately 3/16 inch, etc.

The cutting device frame 120 may include a plurality of interconnected frame panels 127, one or more of which may form a door 128, being moveable from an open position, permitting operator access to internal components of the frame 120, to a closed position, preventing operator access to the internal components of the frame 120. In the embodiment shown in FIGS. 1-2, the door 128 includes a handle 130 that may be grasped by an operator to lift the door 128 into an open position. In some embodiments, the door 128 may be comprised of a transparent material, such as glass, allowing the operator to view internal operations of the cutting device 106 during operation. In certain embodiments, as shown in FIG. 2, the door 128 may rest on door stops 132 when in the open position. Door stops 132 permit the door 128 to remain in the open position while an operator makes adjustments within the cutting device 106.

FIGS. 5-20 show a series of views of the cutting device 106 of the system 100 and various parts thereof. In this embodiment, a fixed axle 134 passes through the frame 120 and is affixed to the frame 120 by a shaft support 136. In other embodiments, other means of affixing the fixed axle 134 to the frame 120 may be employed.

A blade spool 138 is connected to the fixed axle 134 in a manner that allows rotation of the blade spool 138 about the fixed axle 134. In this embodiment, the fixed axle 134 is positioned coaxial with a central axis of the blade spool 138. In the present embodiment, the blade spool 138 includes a spool frame 139 and at least one blade 150 connected to the spool frame 139. Here, the spool frame 139 includes a first spool sidewall 140, a second spool sidewall 142, parallel to and spaced apart from the first spool sidewall 140, and a plurality of guide rods 141 extending between the first spool sidewall 140 and the second spool sidewall 142.

Figure 13:
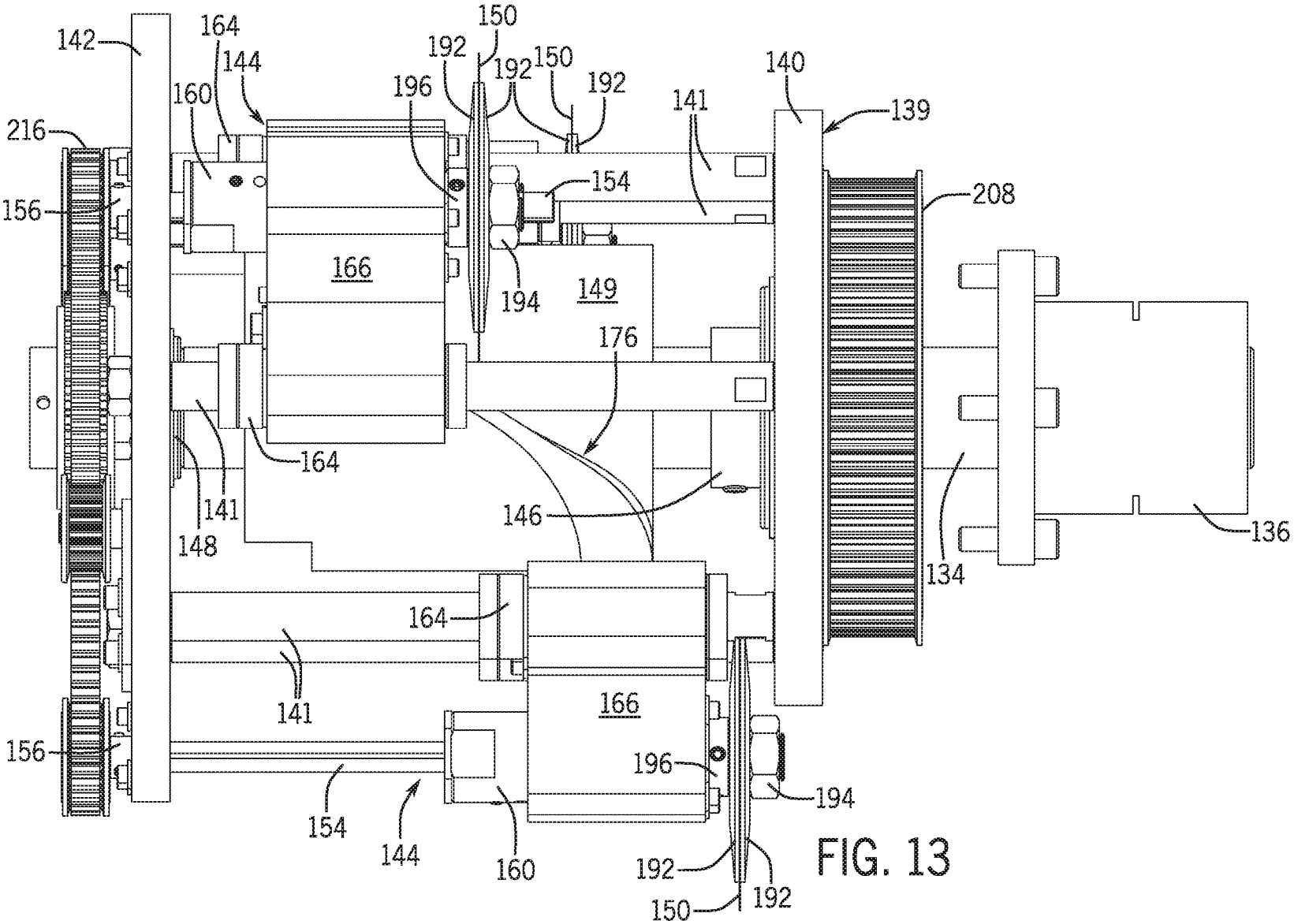
FIG. 13 is a front elevation view of the cutting device shown in FIG. 1, with some elements removed for clarity.
Figure 14:
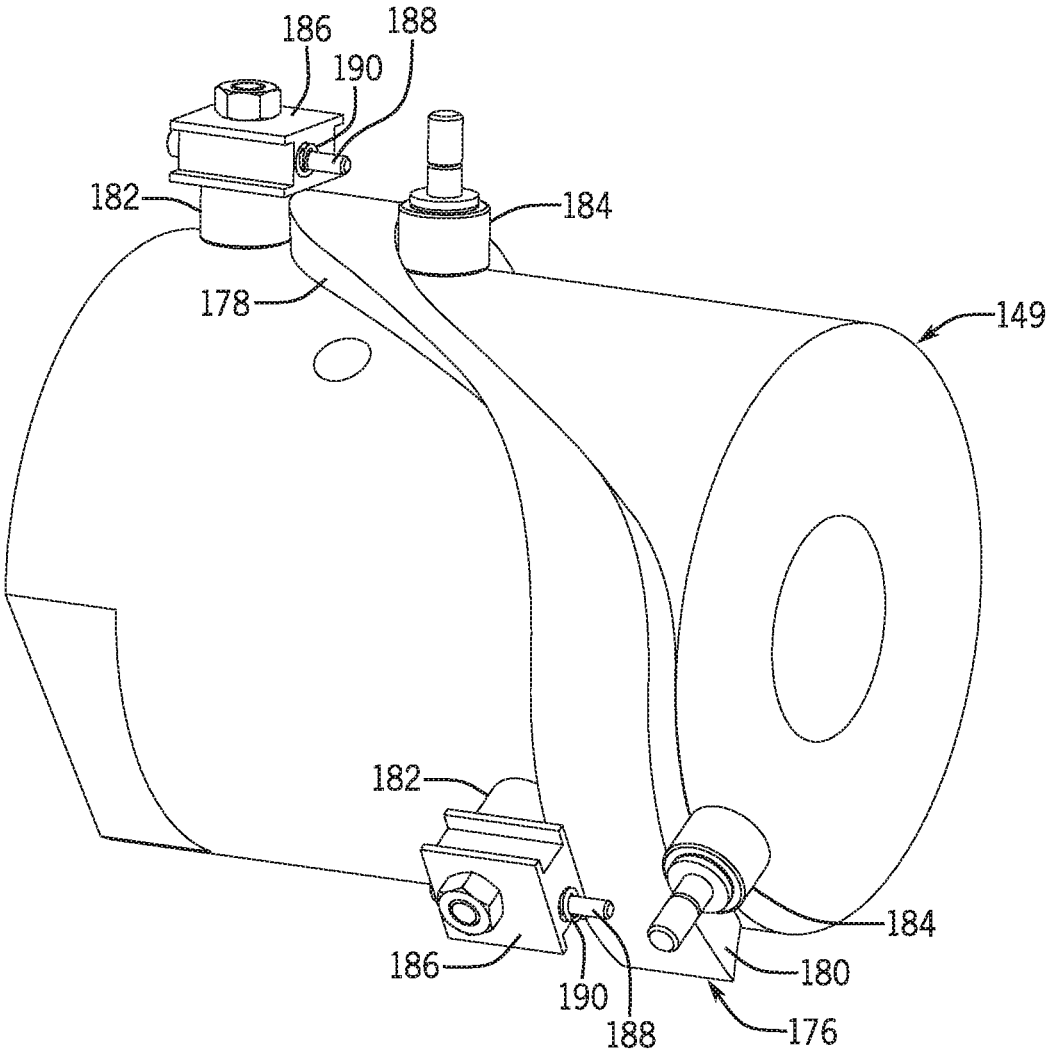
FIG. 14 is a top perspective view of a cam and two sets of cam followers of the cutting device shown in FIG. 1.
Figure 15:
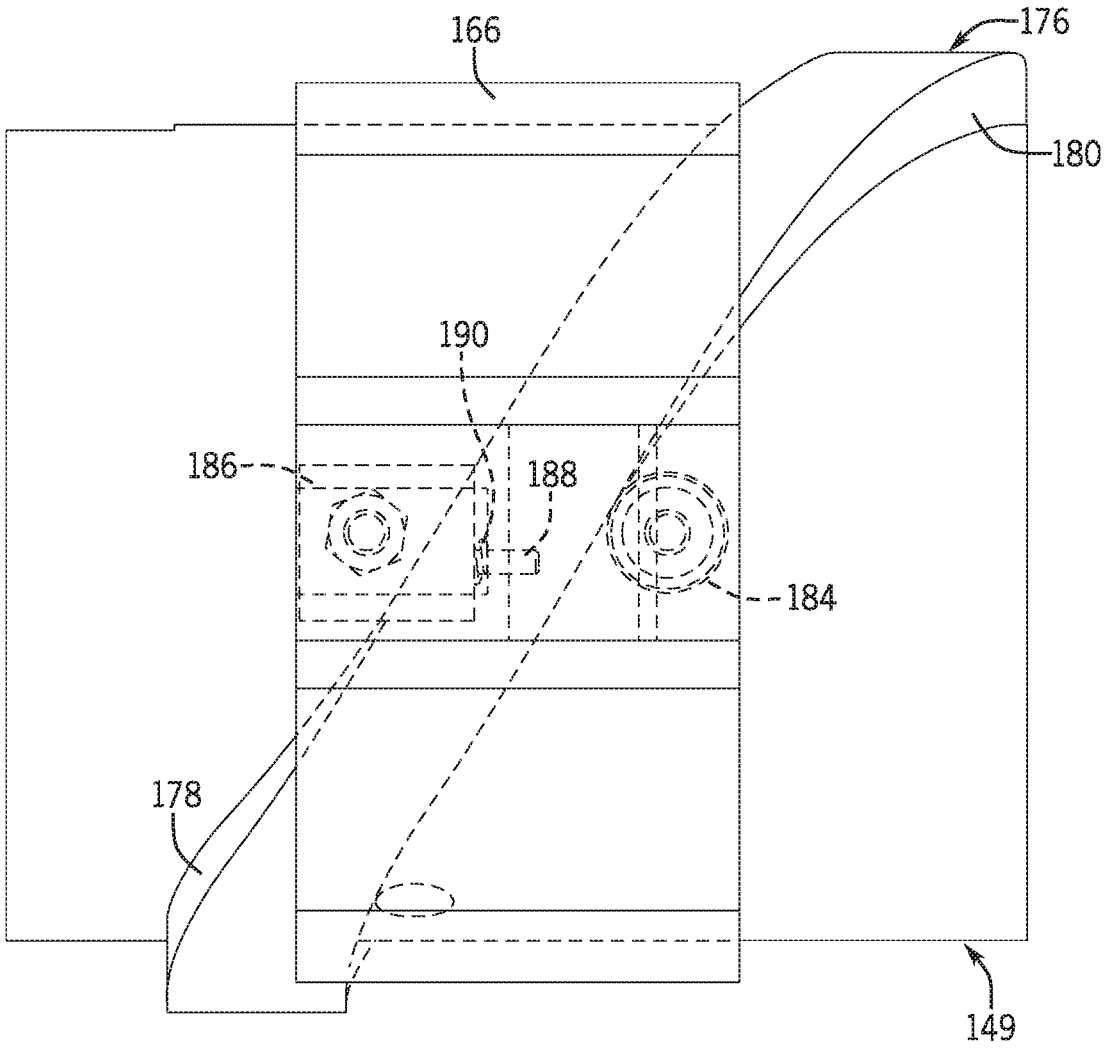
FIG. 15 is a top plan view of the cutting device shown in FIG. 1, with some elements removed for clarity.
Figure 16:
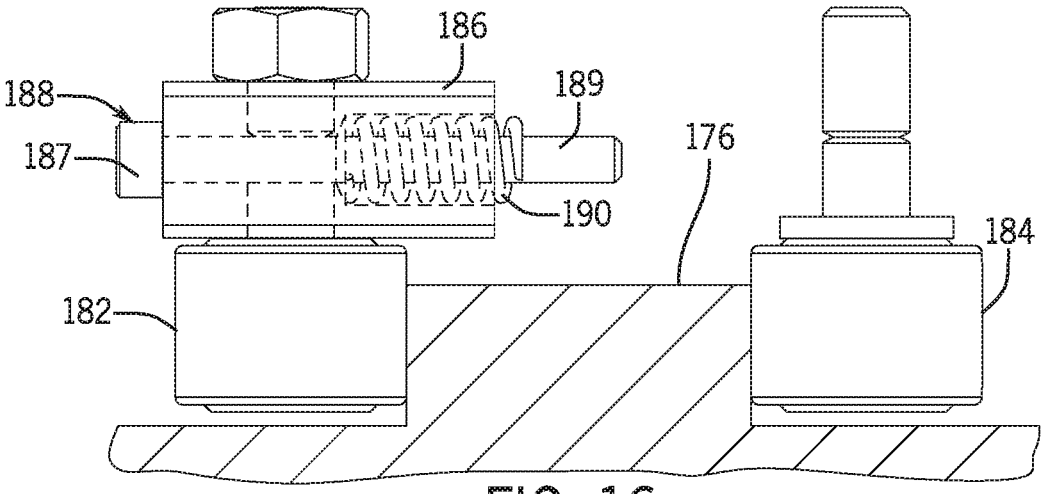
FIG. 16 is an enlarged detail view of the cam and one set of the cam followers shown in FIG. 14 with the cam partially cut away.

Referring to FIG. 13, the first spool sidewall 140 may be connected to the fixed axle 134 by a bearing 146, such as an ER bearing, and the second spool sidewall 142 may be connected to the fixed axle 134 by a bearing 148, such as a ball bearing, allowing rotation of the spool frame 139 with respect to the fixed axle 134. In other embodiments, other forms of bearings, or other types of connections, allowing rotation of the spool frame 139 with respect to the fixed axle 134 are permissible. Additionally, a cam 149 may be attached to the fixed axle 134 in a manner fixed against rotation with respect to the fixed axle 134. In the present embodiment, the cam 149 is a rib barrel cam, but in other embodiments, different forms of cams may be employed.

Figures 37, 37A:
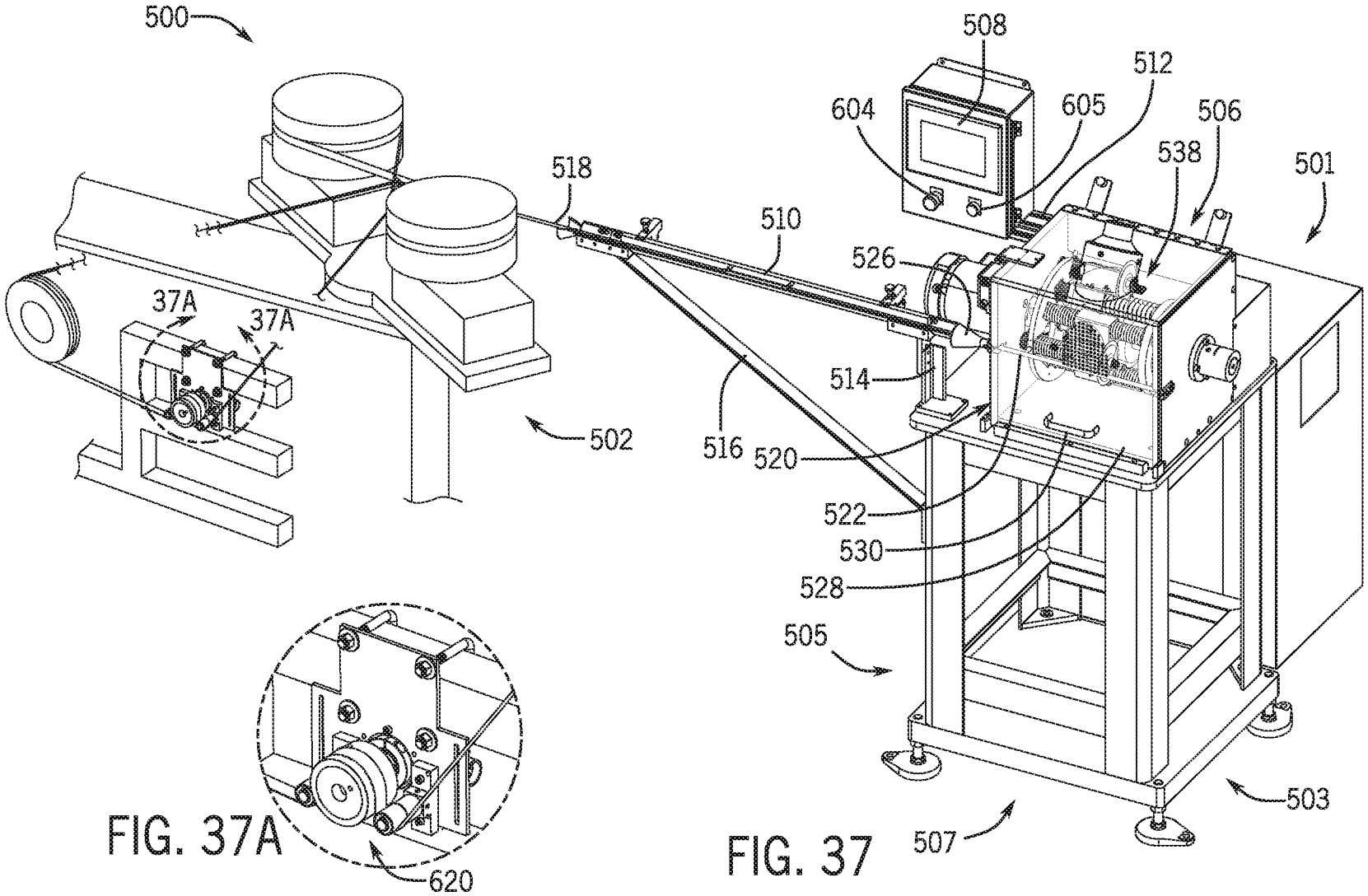
FIG. 37 is a top perspective view of a system for cutting straws, according to another embodiment of the present disclosure, including a winding device, a control monitor, an encoder, and a cutting device.
FIG. 37A is an enlarged detail view of the encoder shown in FIG. 37.
Figure 38:
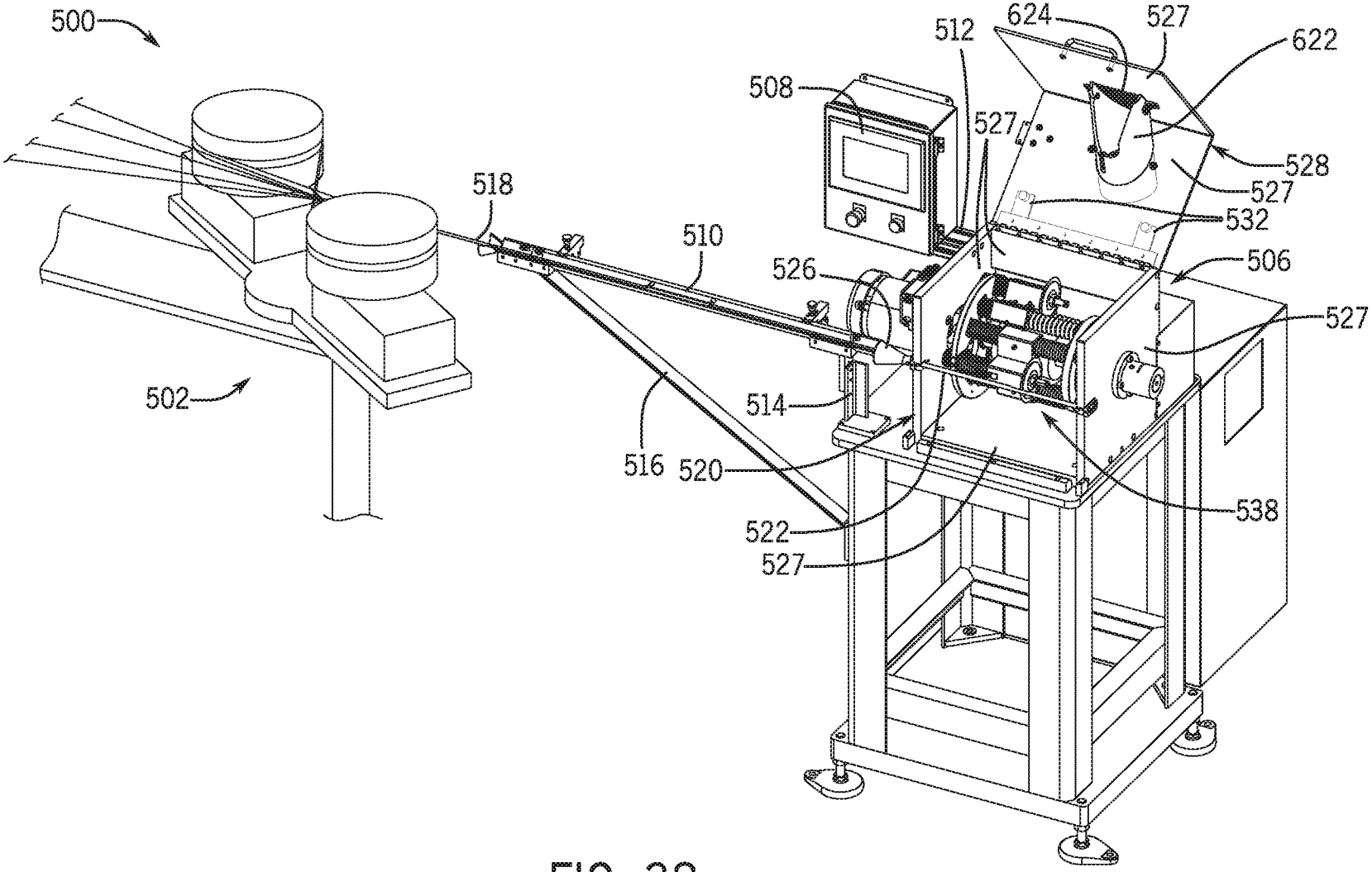
FIG. 38 is another top perspective view of the system shown in FIG. 37 with a door of the cutting device lifted into an open position.

Each blade 150 is positioned on the spool frame 139 such that the rotation of the blade spool 138 brings the blade 150 into contact with the tubing 118 when the tubing 118 is in a position to be cut within the tubing guide 122. As shown best in FIG. 7, the tubing guide 122 may form an opening 147 where a given blade 150 requires access to the tubing 118 to cut the tubing 118. In some embodiments, a waste opening 151 may be formed in the cutting device 106 and, in some instances, the support structure 104. In certain embodiments, in particular those in which the direction of blade 150 rotation results in the dispelling of waste in a substantially downward direction, the waste opening 151 may be formed beneath the location where each blade 150 contacts the tubing 118, as shown in the present embodiment. In other embodiments, in particular those in which the direction of blade 150 rotation results in the dispelling of waste in a substantially upward direction, the waste opening may be formed above the location where each blade 150 contacts the tubing 118, as shown in FIGS. 37-38. The waste opening 151 provides access to a waste chute 152 through which waste, such as paper dust, produced during the cutting process, may be dispelled. The waste chute 152 may connect to the support structure 104, for example, when located beneath the cutting location, and may also be configured to connect to a source of vacuum, such as a vacuum hose, to further facilitate the removal of waste from the cutting device 106.

In the embodiment depicted in FIGS. 1-20, each blade 150 is part of a blade assembly 144 that connects to the spool frame 139. In this embodiment, the blade spool 138 includes three blade assemblies 144 connected to the spool frame 139. In other embodiments, a different number of blade assemblies may be connected to the spool frame. For instance, in the embodiment depicted in FIGS. 21-36, the blade spool 338 includes two blade assemblies 344 connected to the spool frame 339. In the present embodiment, each blade assembly 144 includes a blade shaft 154. As shown in FIG. 13, the blade shaft 154 protrudes through the second spool sidewall 142, normal to the second spool sidewall 142, and is connected to the second spool sidewall 142 by a blade shaft bearing 156. In this embodiment, each blade assembly 144 further includes a blade shaft driven pulley 158 and a sliding member 160, each connected to the blade shaft 154 and each fixed against rotation with respect to the blade shaft 154. The sliding member 160 is free to slide along the length of the blade shaft 154. As shown in FIG. 20, the sliding member 160 is a spindle, and the spindle is connected to the blade shaft 154 by a spline nut 162. However, in other embodiments, other types of sliding members and other forms of connection that permit sliding of the sliding member 160 with respect to the blade shaft 154 are permissible.

The blade 150 may be positioned on the sliding member 160, the plane of the blade 150 normal to the longitudinal axis of the sliding member 160. The blade 150 may further be fixed against rotation with respect to the sliding member 160. In the present embodiment, a collar 196 (FIG. 13) is affixed to the sliding member 160, and the blade 150 is secured to the sliding member 160 by a pair of keyed washers 192, connected to the sliding member 160 on either side of the blade 150, and a blade nut 194, screwed onto the sliding member 160 such that the blade 150 and keyed washers 192 are locked in position against the collar 196.

Further included in the blade assembly 144 is at least one bushing 164. In this embodiment, each blade assembly 144 includes two bushings 164, each connected to one of the guide rods 141 in a manner that permits sliding along the respective guide rod 141. A blade carriage 166 connects the sliding member 160 to the bushings 164, and thereby, in effect, connects the blade 150 slidably to the guide rods 141.

Figure 19:
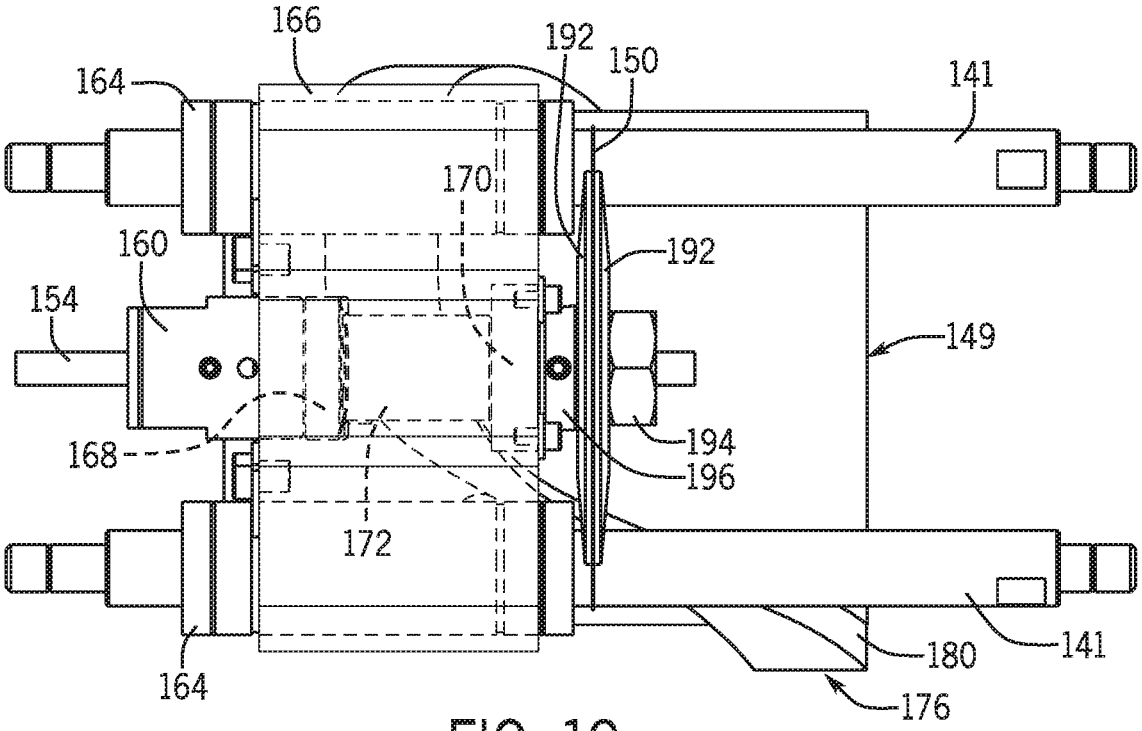
FIG. 19 is a top plan view of the cutting device shown in FIG. 1, with some elements removed for clarity.
Figure 20:
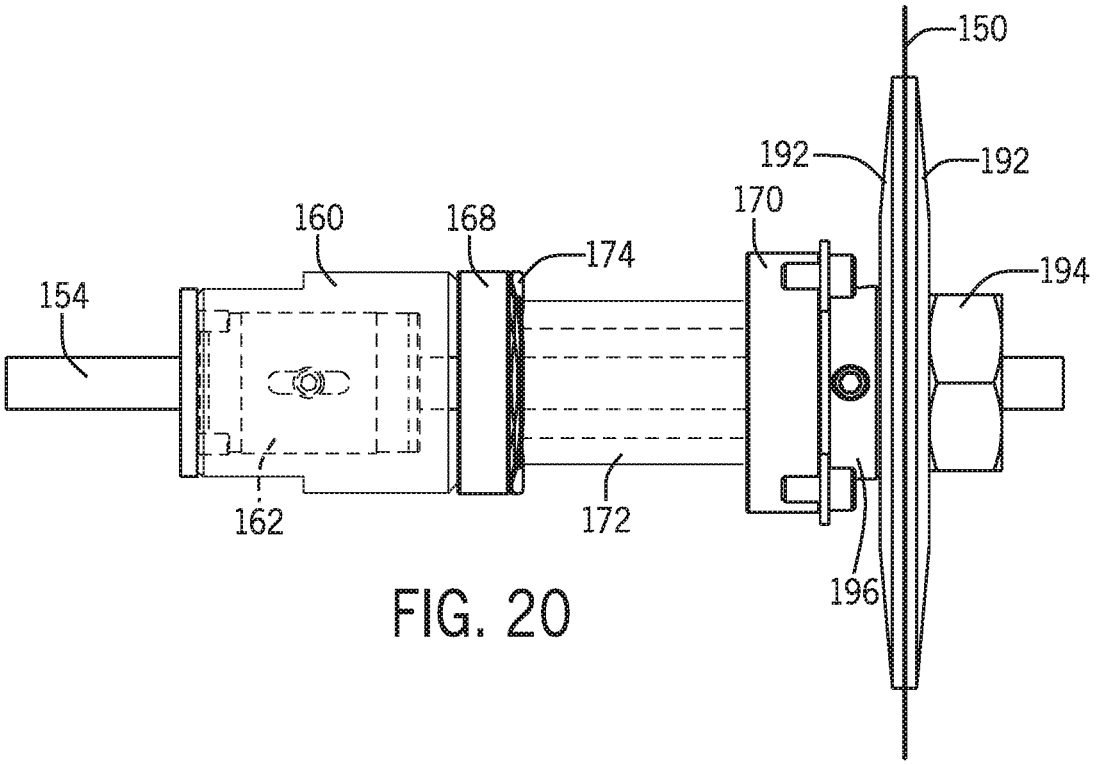
FIG. 20 is a top plan view of a blade shaft and related components of the cutting device shown in FIG. 1.

Referring now to FIGS. 19 and 20, in this embodiment, the blade carriage 166 includes a first blade carriage bearing 168 and a second blade carriage bearing 170, separated by a bearing spacer 172, which permit the sliding member 160 to rotate with respect to the blade carriage 166 when the blade shaft 154 rotates. A wave spring 174 may be positioned between the first blade carriage bearing 168 and the bearing spacer 172 to absorb intermittent shock loads and compensate for any internal expansion or contraction between the first blade carriage bearing 168 and the second blade carriage bearing 170. The presence of the wave spring 174 permits higher manufacturing tolerances with respect to the corresponding parts and compensates for wear.

Referring now mainly to FIGS. 14-18, each blade assembly 144 includes at least one cam follower. In the present embodiment, a rib 176 having a first rib face 178 and an oppositely facing second rib face 180 is defined along the surface of the cam 149. In this embodiment, the blade assembly 144 includes a first cam follower 182, connected to the blade carriage 166 and bearing on the first rib face 178, and a second cam follower 184, connected to the blade carriage 166 and bearing on the second rib face 180. The first and second cam followers 182, 184 are connected to the blade carriage 166 in a manner that permits rotation of the cam followers 182, 184 with respect to the blade carriage 166 when the first and second cam followers 182, 184 are respectively moved along the first and second rib faces 178, 180, that is, as the blade carriage 166 moves along the rib 176.

The first cam follower 182 includes a block 186 and a fastener 188. The fastener 188 includes a head portion 187 abutting an exterior side of the block 186 and a thread portion 189 that extends through the block 186 and is secured to the blade carriage 166. The block 186 is permitted slight lateral movement along the remainder of the thread portion 189 to compensate for minor irregularities in the spacing between the rib faces 178, 180. A spring 190 (FIGS. 15-16), coiled around the thread portion 189, abuts both the blade carriage 166 and the block 186 at respective ends, providing for tension and backlash adjustments as the first cam follower 182 follows the first rib face 178.

In the embodiment shown in FIGS. 1-20, the cutting device 106 further includes a servo motor 200. As shown best in FIGS. 7 & 9, the servo motor 200 includes a servo shaft 202 that connects to a first driving pulley 203. A first timing belt 206 may be secured about the first driving pulley 203 and a spool driven pulley 208. In the present embodiment, the spool driven pulley 208 is fastened to the exterior of the first spool sidewall 140. Thereby, the servo motor 200 controls the rotation of the blade spool 138.

Looking mainly at FIGS. 7 and 10-12, the cutting device 106 of the present embodiment further includes a blade drive motor 210. The blade drive motor 210 includes a blade drive shaft 212 that connects to a second driving pulley 214. A second timing belt 216 is engaged about the second driving pulley 214 and each of the blade shaft driven pulleys 158. In certain embodiments, one or more idler or tensioner pulleys 218 may be connected to the second spool sidewall 142 and positioned to add tension to the second timing belt 216. In the present embodiment, a single idler pulley 218 is utilized. However, in other embodiments, a different number of idler pulleys 218 may be utilized. For instance, in the embodiment shown in FIGS. 21-36, two idler pulleys 418 are utilized.

Figure 2:
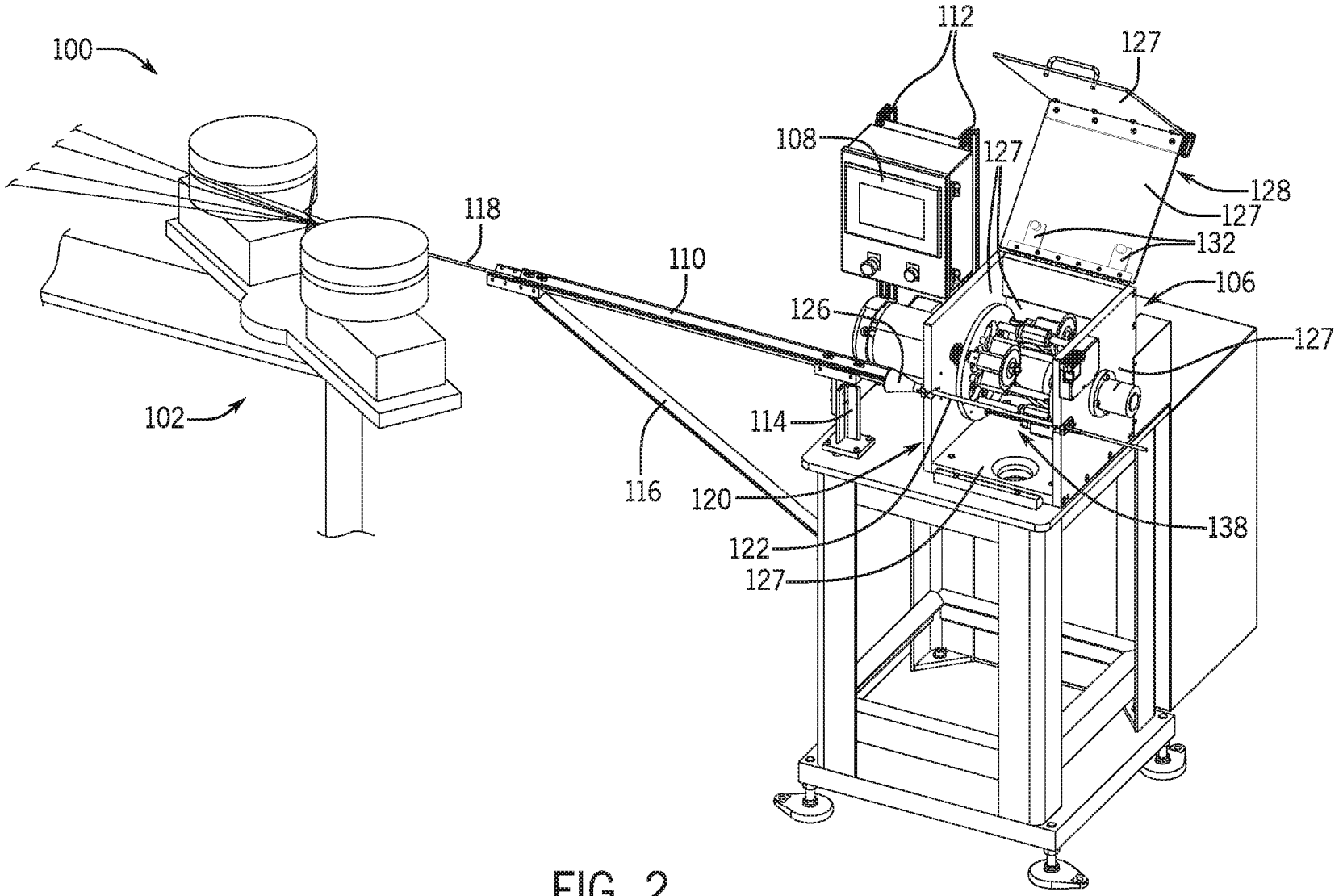
FIG. 2 is another top perspective view of the system shown in FIG. 1 with a door of the cutting device lifted into an open position.
Figure 3:
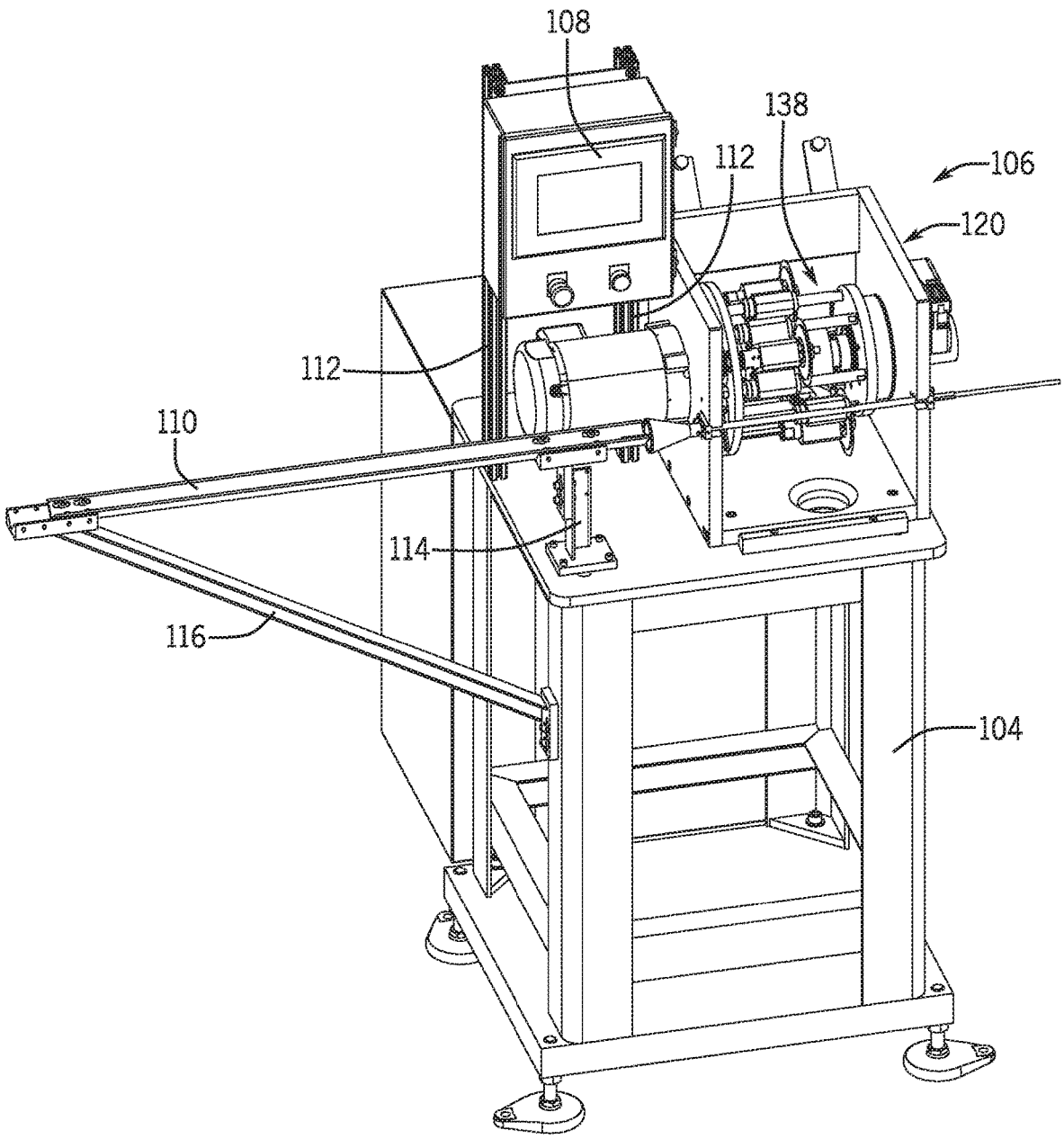
FIG. 3 is another top perspective view of the system shown in FIG. 1, with the winding device and the door of the cutting device respectively removed for clarity.
Figure 4:
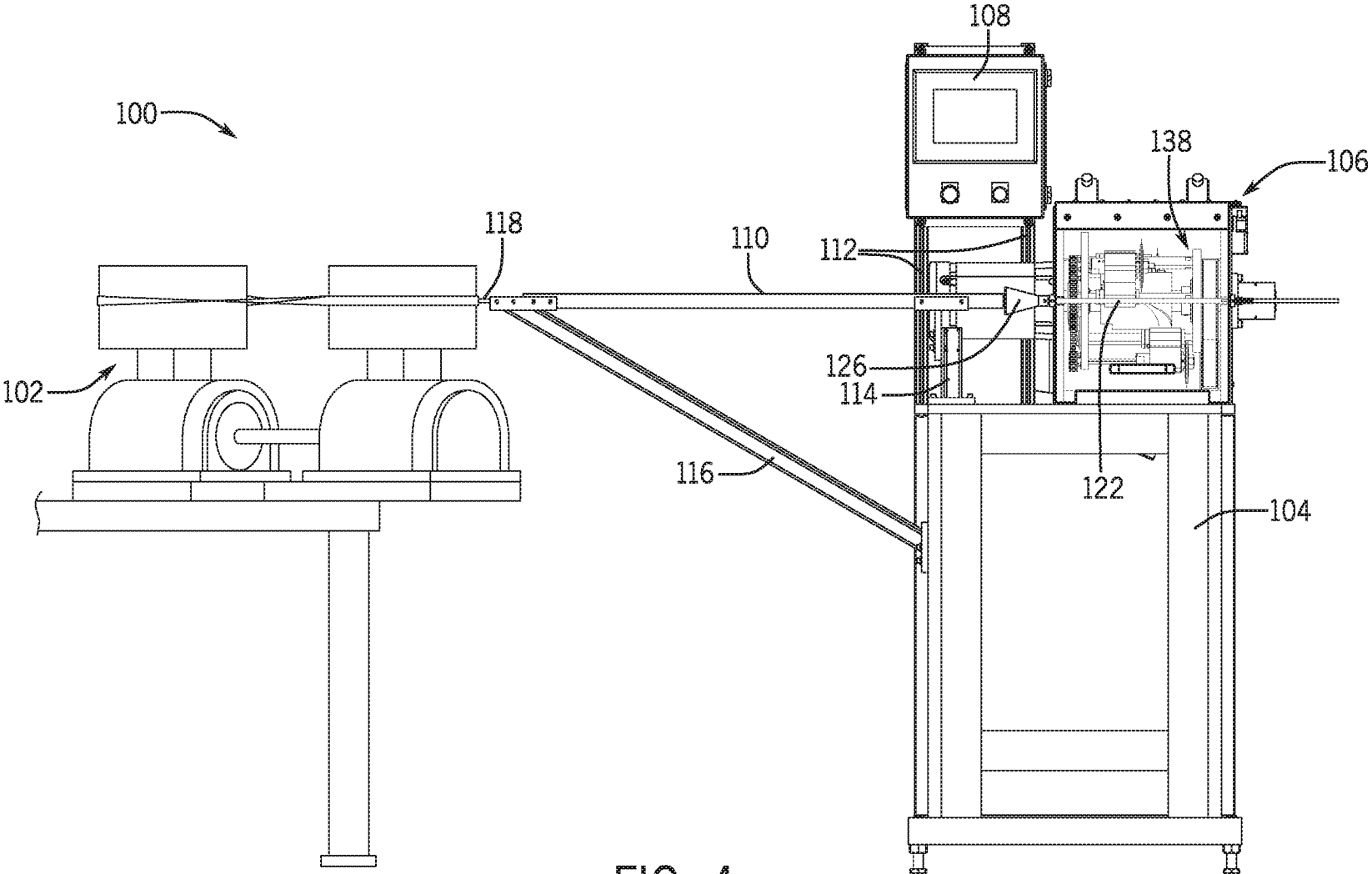
FIG. 4 is a front elevation view of the system shown in FIG. 1.
Figure 5:
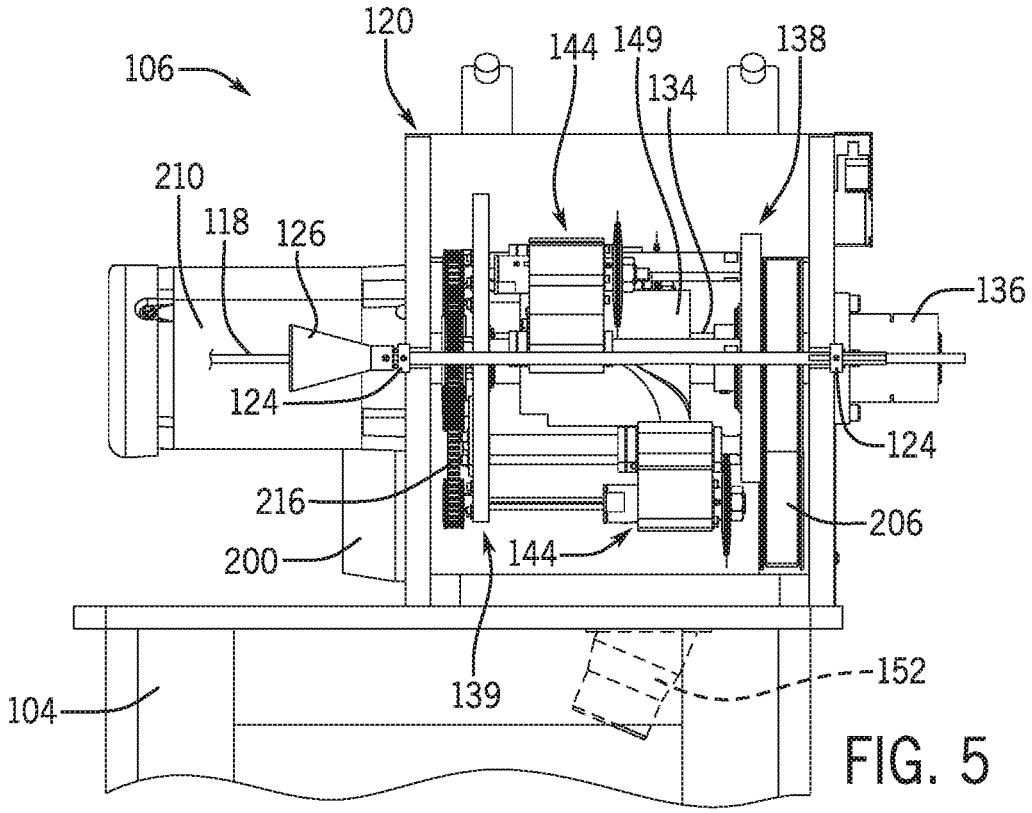
FIG. 5 is a front elevation view of the cutting device shown in FIG. 1.
Figure 6:
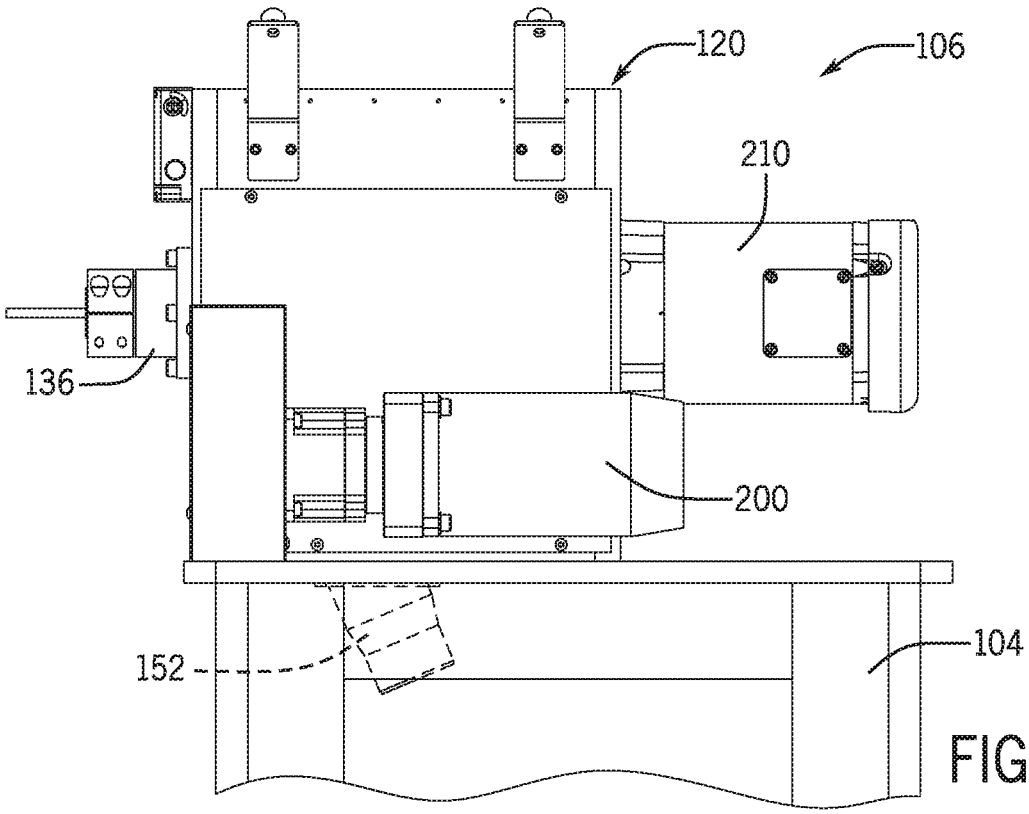
FIG. 6 is a rear elevation view of the cutting device shown in FIG. 1.
Figure 7:
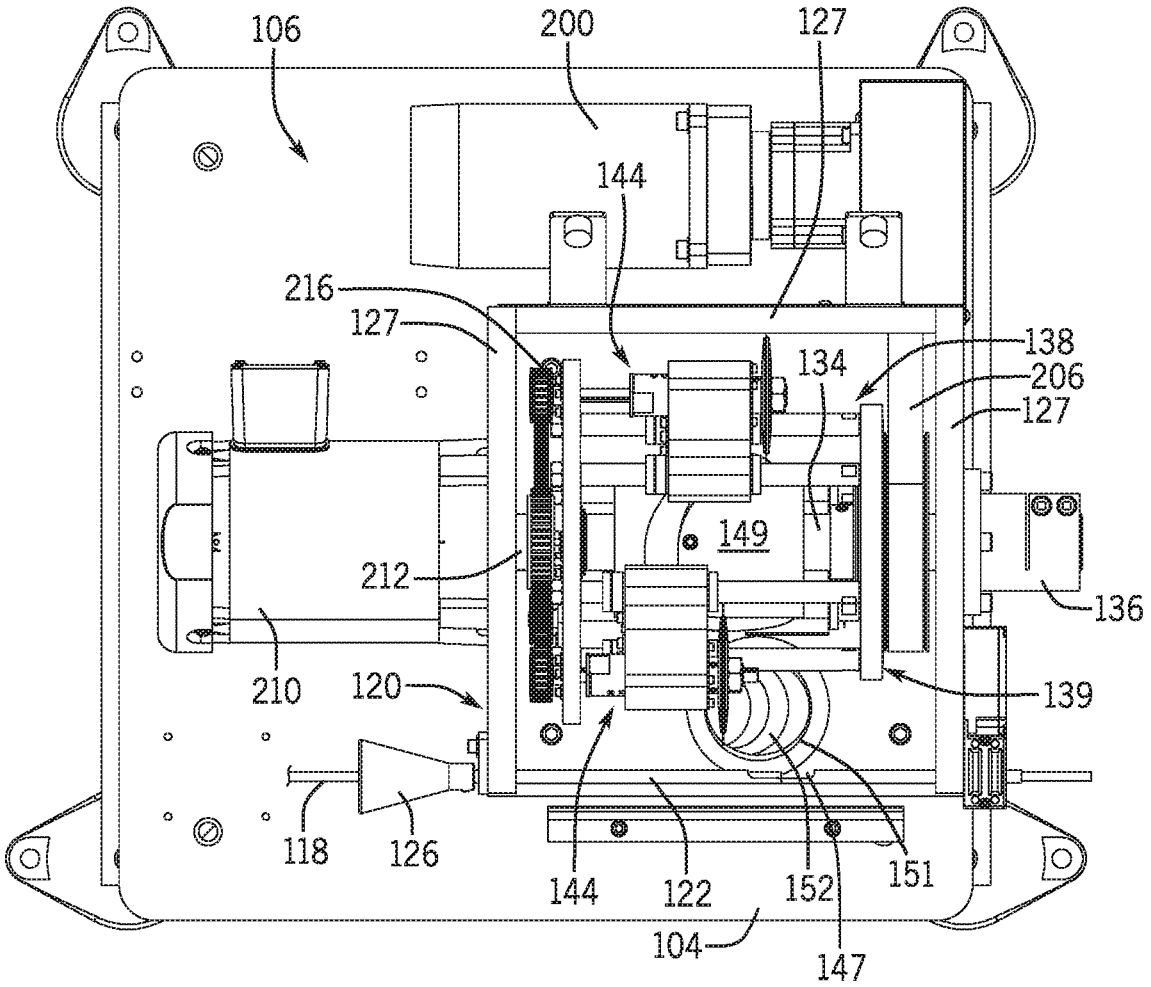
FIG. 7 is a top plan view of the cutting device shown in FIG. 1.
Figure 8:
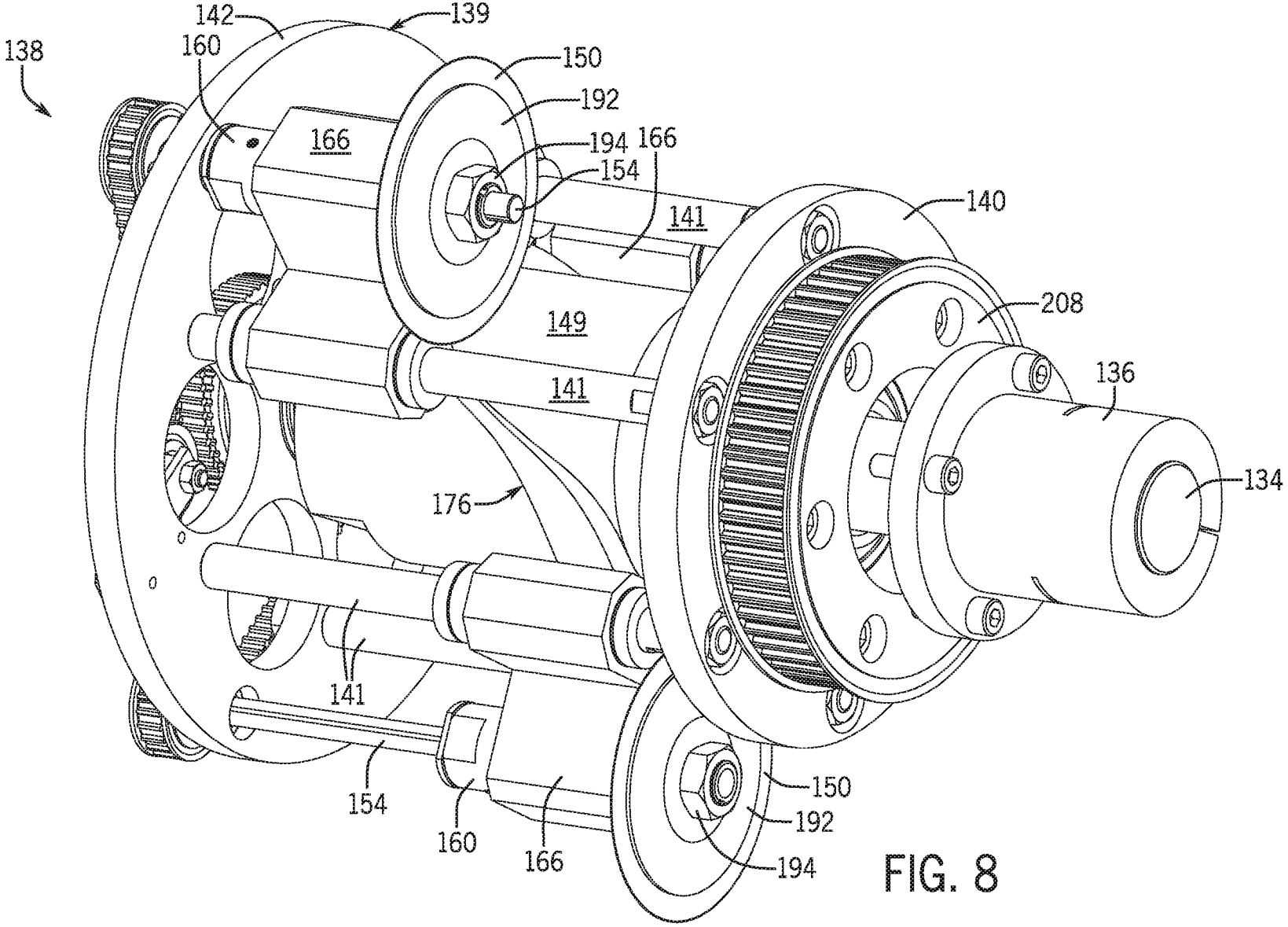
FIG. 8 is a top perspective view of the cutting device shown in FIG. 1, viewed from the right side, with some elements removed for clarity.
Figure 9:
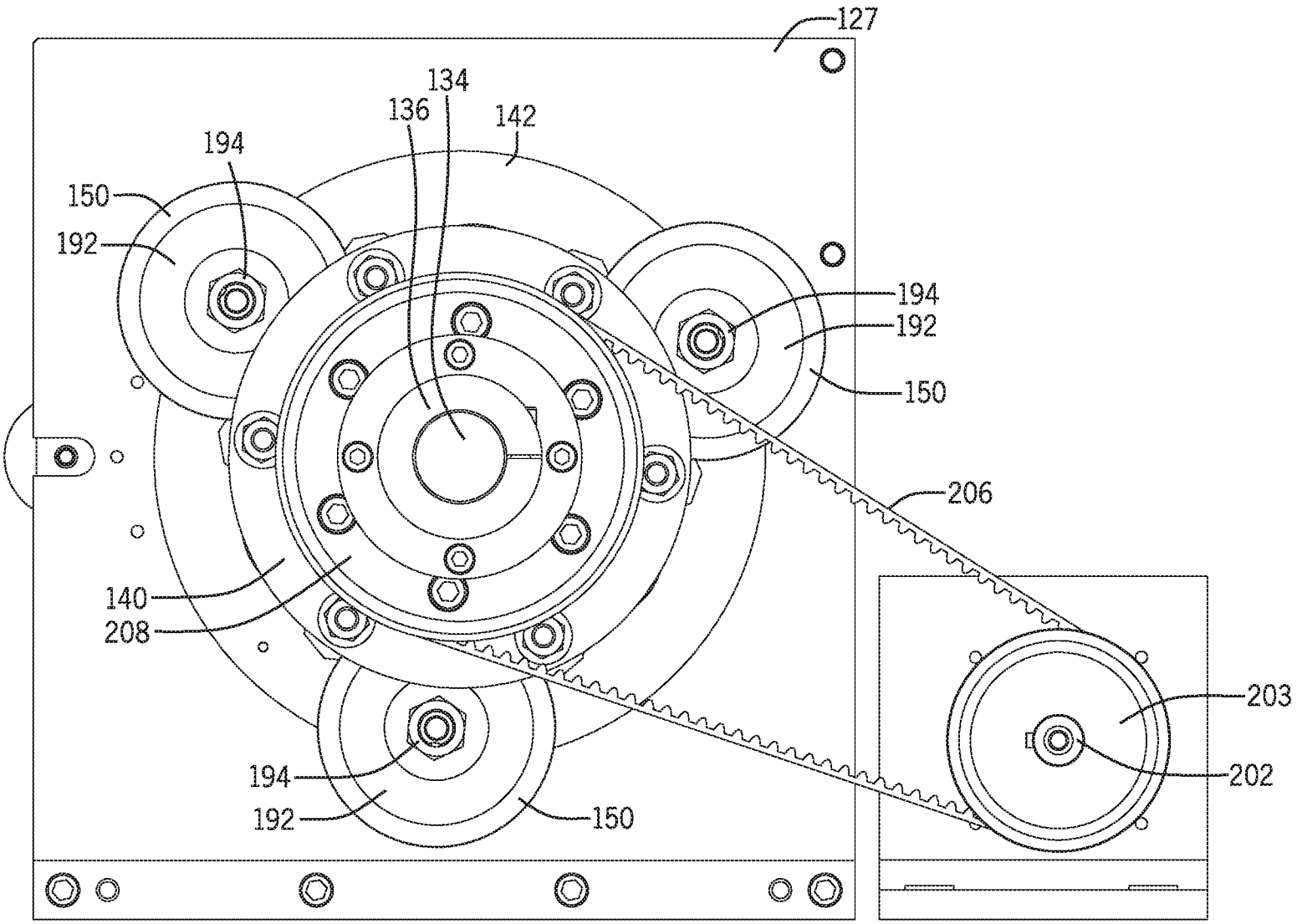
FIG. 9 is a right side elevation view of the cutting device shown in FIG. 1, with some elements removed for clarity.
Figure 10:
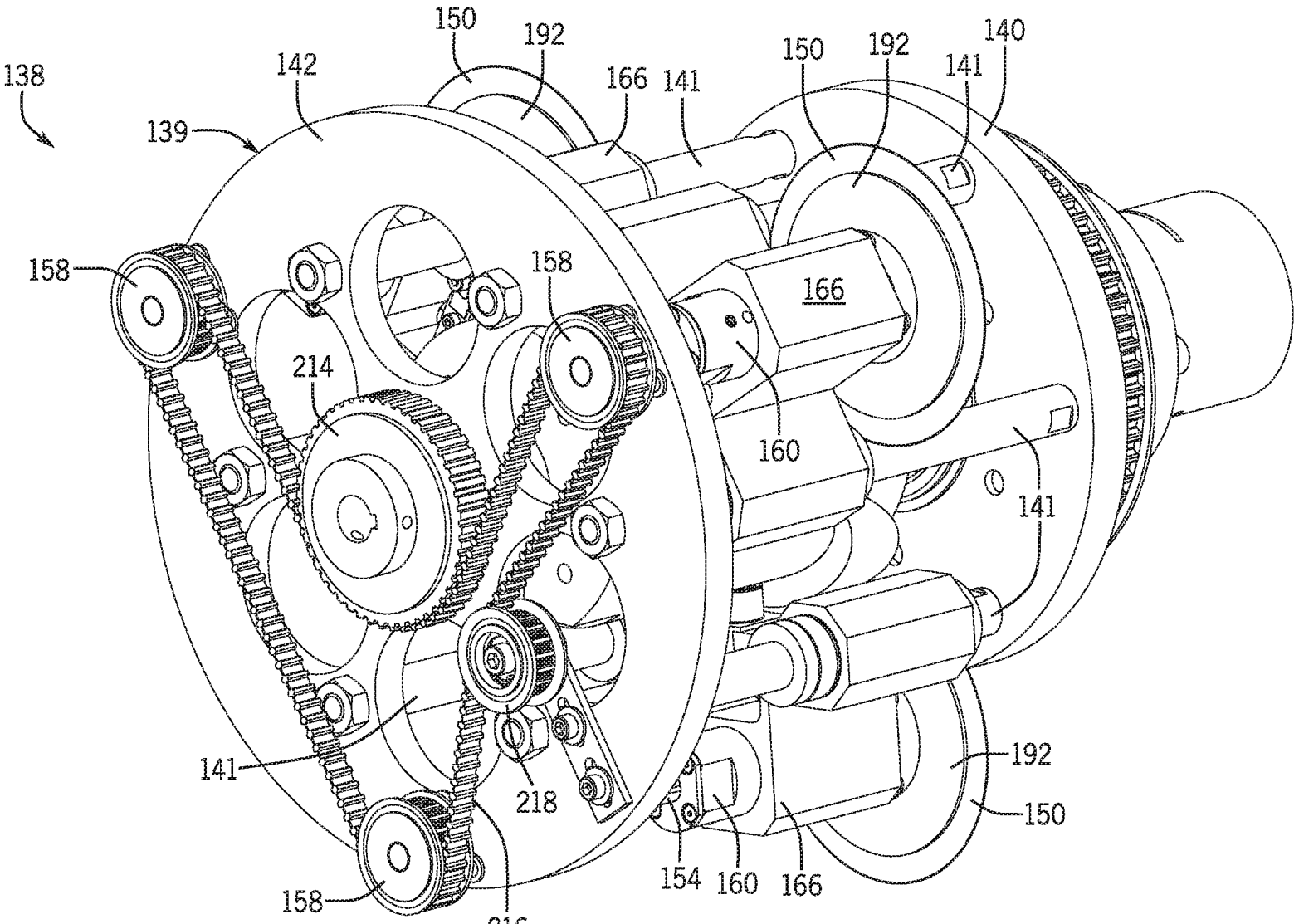
FIG. 10 is a top perspective view of the cutting device shown in FIG. 1, viewed from the left side, with some elements removed for clarity.
Figure 11:
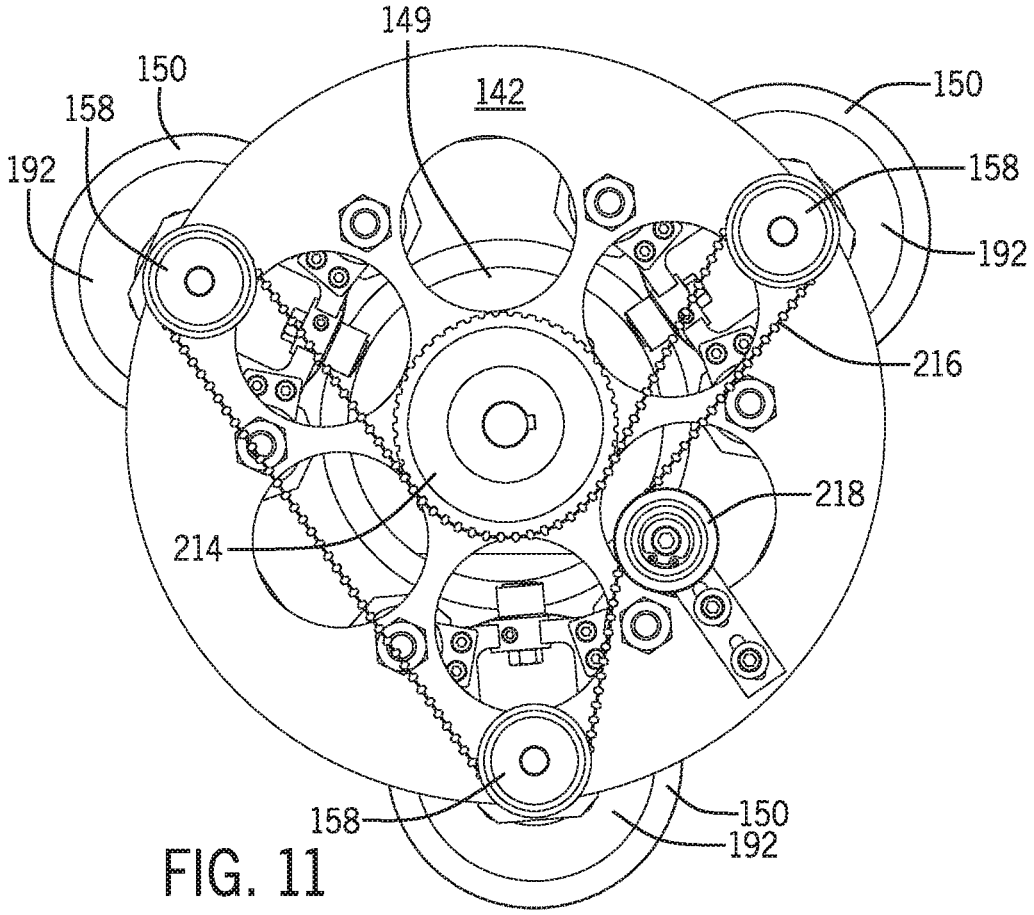
FIG. 11 is a left side elevation view of the cutting device shown in FIG. 1, with some elements removed for clarity.
Figure 12:
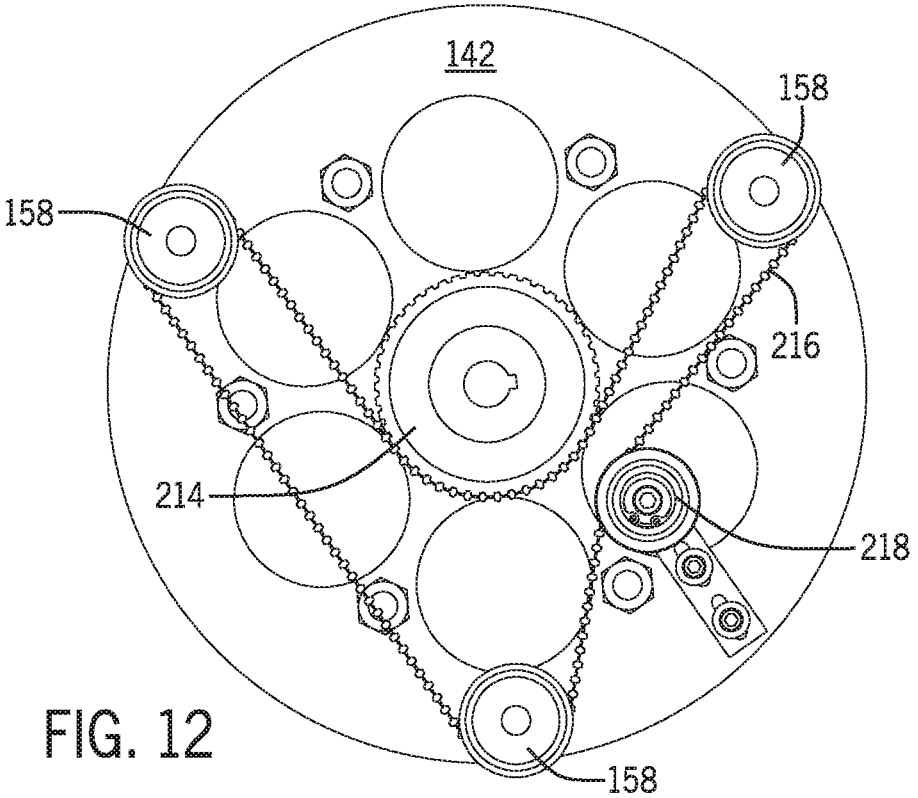
FIG. 12 is another left side elevation view of the cutting device shown in FIG. 1, with some elements removed for clarity.

As shown best in FIGS. 1-1A, the system 100 further includes an encoder 220 that communicates with the servo motor 200 to establish appropriate accelerations or decelerations of the blade spool 138 rotational speed based on the speed at which the tubing 118 is formed in the winding device 102 and fed through the cutting device 106. The control monitor 108 may include advance and retard controls, which respectively allow the operator to make manual adjustments to the blade spool 138 rotational speed established by the communication between the servo motor 200 and the encoder 220. Additionally, the control monitor 108 may include an emergency stop control 204 and a power control 205. In this embodiment, the emergency stop and power controls 204, 205 are external buttons.

During operation of the system 100, the winding device 102 winds a material into the tubing 118. In this embodiment, the material may be comprised of paper. The tubing 118 is then transferred to the cutting device 106. In this embodiment, the winding device 102 moves the tubing 118 continuously along the angle guide 110, into the funnel 126, and then through the tubing guide 122, where the tubing 118 is cut to a desired straw length.

In this embodiment, the tubing 118 is cut to a desired straw length by rotating the blade 150 of each blade assembly 144 about a central axis of the blade 150 while revolving each blade assembly 144 about the central axis of the blade spool 138, such that each blade 150 is sequentially brought into contact with the tubing 118 when the tubing 118 is moved into a proper position to be cut, and sliding the blade 150 in a direction coinciding with the direction in which the tubing 118 is moving, at least while the tubing 118 is being cut. In the present embodiment, there are three blade assemblies 144, each revolving about the central axis of the blade spool 138 and sequentially cutting a desired straw length of the tubing 118. A commonly desired straw length is approximately 8 inches. However, the system 100 may be calibrated to cut straws of other lengths, as well.

To accomplish the rotation of the blade 150, according to the present embodiment, the blade drive motor 210 rotates the blade drive shaft 212, which in turn rotates the second driving pulley 214. The second driving pulley 214, when rotated, applies a force to the second timing belt 216 sufficient to move the timing belt in a manner that likewise rotates each blade shaft driven pulley 158. The rotation of each blade shaft driven pulley 158 rotates each respective blade shaft 154 and likewise, each respective blade 150. Each blade 150 in this embodiment is rotated at a substantially constant speed of approximately 7500 rpm. However, other rotational speeds may be used.

In the embodiment shown in FIGS. 1-20, each blade assembly 144 is revolved around the central axis of the blade spool 138 through rotation of the spool frame 139, to which each blade assembly 144 is connected. To rotate the spool frame 139 of the present embodiment, the servo motor 200 rotates the servo shaft 202, which in turn rotates the first driving pulley 203. The first driving pulley 203, when rotated, applies a force to the first timing belt 206 sufficient to move the timing belt in a manner that likewise rotates the spool driven pulley 208. The rotation of the spool driven pulley 208 rotates the spool frame 139. The rotational speed of the blade spool 138 varies. To establish the rotational speed pattern of the blade spool 138, the encoder 220 transfers signals to the servo motor 200 related to the speed at which the tubing 118 is moving through the cutting device 106 and appropriate accelerations or decelerations to the rotational speed of the blade spool 138, accordingly. Furthermore, when necessary to promote smoother rotation of the blade spool 138, the operator may manually accelerate or decelerate the rotational speed of the blade spool 138 using the control monitor 108. A smoother rotation of the blade spool 138 may result in cleaner cuts of the tubing 118, with fewer jagged edges resulting from a given cut.

The sliding of the blade 150 is accomplished in this embodiment by the cam followers 182, 184 bearing along the rib 176 as the blade spool 138 rotates. In this embodiment, the first cam follower 182 bears along the first rib face 178, and the second cam follower 184 coincidingly bears along the second rib face 180 as the blade spool 138 rotates and the cam 149 remains stationary with respect to the device frame 120. In the present embodiment, to cut an 8 inch straw, the blade 150 contacts the tubing 118 for a distance of approximately 1.00-1.25 inches as the cut is made. In other embodiments, this distance may vary based on factors such as the desired straw length, the speed with which tubing 118 moves through the tubing guide 122, the rotational speed of the blade spool 138 and blades 150, etc. The sliding of the blade 150 as the blade 150 cuts through the tubing 118 allows the blade 150 to make a clean cut without the need to stop the movement of the tubing 118 through the tubing guide 122 and/or the rotation of the blade spool 138.

Finally, the cutting of the tubing 118 with the blade 150 may produce waste, such as dust and tubing material clippings. According to certain embodiments, a source of vacuum, such as a vacuum hose, connected to the waste chute 152 may draw such waste through the waste chute 152 and out of the cutting device 106. The direction in which the waste is substantially dispelled may vary depending on the rotational direction of the blade 150. For instance, in an embodiment in which the blade 150 is rotated in a forward direction, the waste may be substantially dispelled in a downward direction. In such an embodiment, it may be beneficial to remove the waste from below the cutting location, as shown in the configuration of the present embodiment. Alternatively, in an embodiment in which the blade 150 is rotated in a rearward direction, the waste may be substantially dispelled in an upward direction. In such an embodiment, it may be beneficial to remove the waste from above the cutting location, as shown in the embodiment illustrated in FIGS. 37-38.

Figure 21:
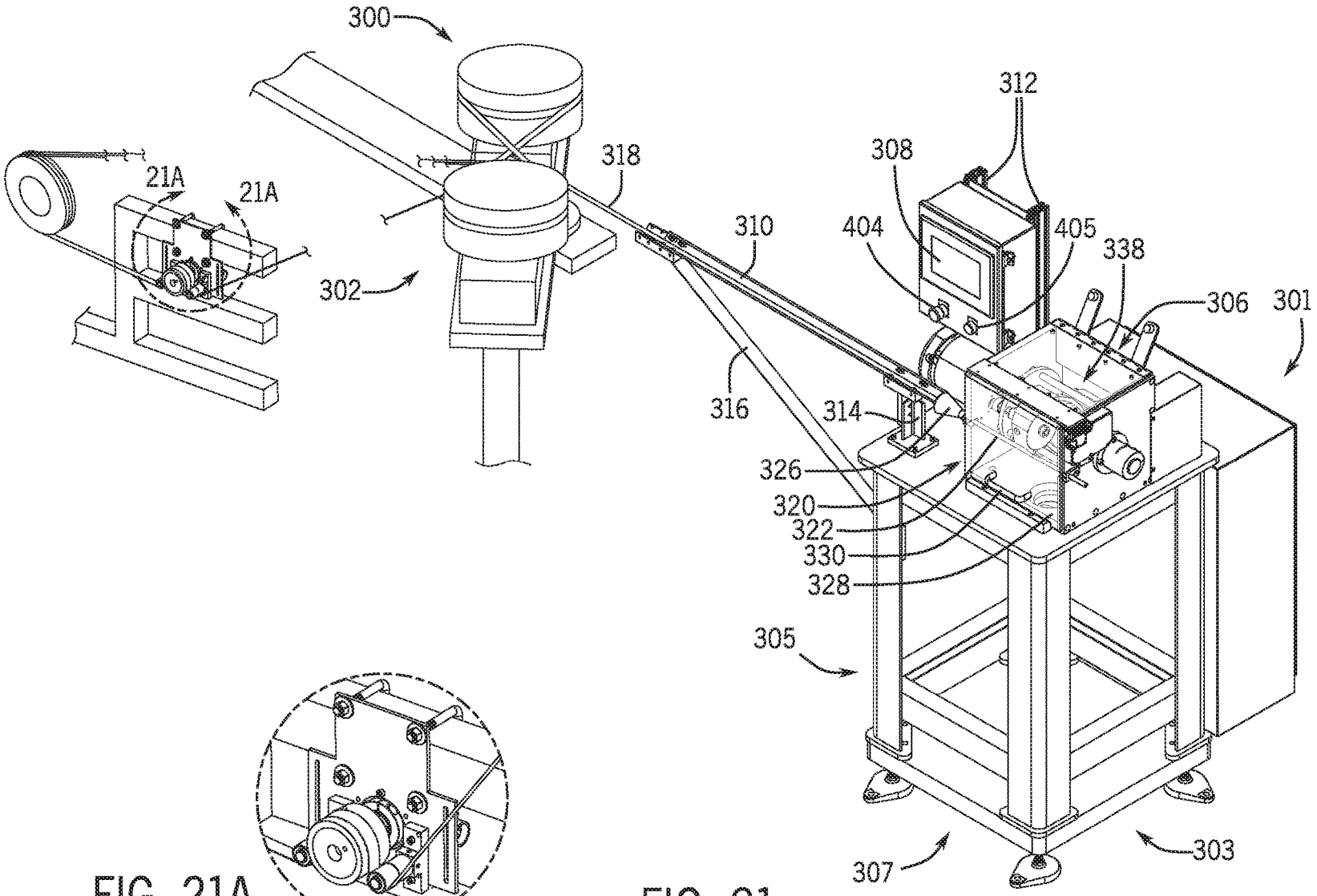
FIG. 21 is a top perspective view of a system for cutting straws, according to another embodiment of the present disclosure, including a winding device, an encoder, a control monitor, and a cutting device.

FIGS. 21-36 show a second embodiment of a system 300 for cutting straws. Referring to FIG. 21, a perspective view of a system 300 is provided. For reference, a rear 301, a right side 303, a left side 305, and a front 307 are identified in FIG. 21.

In the embodiment shown in FIG. 21, the system 300 includes a winding device 302, a support structure 304, a cutting device 306, a control monitor 308, an angle guide 310, and an encoder 420. In the present embodiment, the cutting device 306 is directly mounted to the support structure 304. The control monitor 308 is mounted to the support structure 304 by a pair of monitor support members 312, and the angle guide 310 is mounted to the support structure 304 by a first angle guide support 314 and a second angle guide support 316. In alternative embodiments, alternative means of supporting the cutting device 306, control monitor 308, and angle guide 310 may be permissible. In the present embodiment, the angle guide 310 is sized to guide a tubing 318 formed by the winding device 302 to the cutting device 306. In some embodiments, the tubing 318 is comprised of paper.

In this embodiment, the cutting device 306 includes a frame 320 and a tubing guide 322 protruding through the frame 320 and connected to the frame 320 by tubing guide clamps 324. Attached to the tubing guide 322 and positioned adjacent to the angle guide 310 is a funnel 326 sized to receive the tubing 318 and transfer the tubing 318 from the angle guide 310 to the tubing guide 322. In the present embodiment, the funnel 326 and the tubing guide 322 are sized to receive jumbo drinking straw tubing, having a diameter of approximately ¼ inch. However, in other embodiments, other funnel and tubing guide sizes may be employed to accommodate alternatively sized tubing. For instance, in alternative embodiments, a funnel and tubing guide may be utilized that are sized to receive giant drinking straw tubing, having a diameter of approximately 5/16 inch, colossal drinking straw tubing, having a diameter of approximately 7/16 inch, boba drinking straw tubing, having a diameter of approximately ½ inch, cocktail straw tubing, having a diameter of approximately 3/16 inch, etc.

The cutting device frame 320 may include a door 328, moveable between an open position, permitting operator access to internal components of the frame 320, and a closed position, preventing operator access to the internal components of the frame 320. In the embodiment shown in FIG. 21, the door 328 includes a handle 330 that may be grasped by an operator to lift the door 328 into an open position. In some embodiments, the door 328 may be comprised of a transparent material, such as glass, allowing the operator to view internal operations of the cutting device 306 during operation. In certain embodiments, the door 328 may rest on door stops 332 when in the open position. Door stops 332 permit the door 328 to remain in the open position while an operator makes adjustments within the cutting device 306.

FIGS. 22-36 show a series of views of the cutting device 306 of the system 300 and various parts thereof. In this embodiment, a fixed axle 334 passes through the frame 320 and is affixed to the frame 320 by a shaft support 336. In other embodiments, other means of affixing the fixed axle 334 to the frame 320 may be employed.

A blade spool 338 is connected to the fixed axle 334 in a manner that allows rotation of the blade spool 338 about the fixed axle 334. In this embodiment, the fixed axle 334 is positioned coaxial with a central axis of the blade spool 338. In the present embodiment, the blade spool 338 includes a spool frame 339 and at least one blade 350 connected to the spool frame 339. Here, the spool frame 339 includes a first spool sidewall 340, a second spool sidewall 342, parallel to and spaced apart from the first spool sidewall 340, and a plurality of guide rods 341 extending between the first spool sidewall 340 and the second spool sidewall 342.

Figure 29:
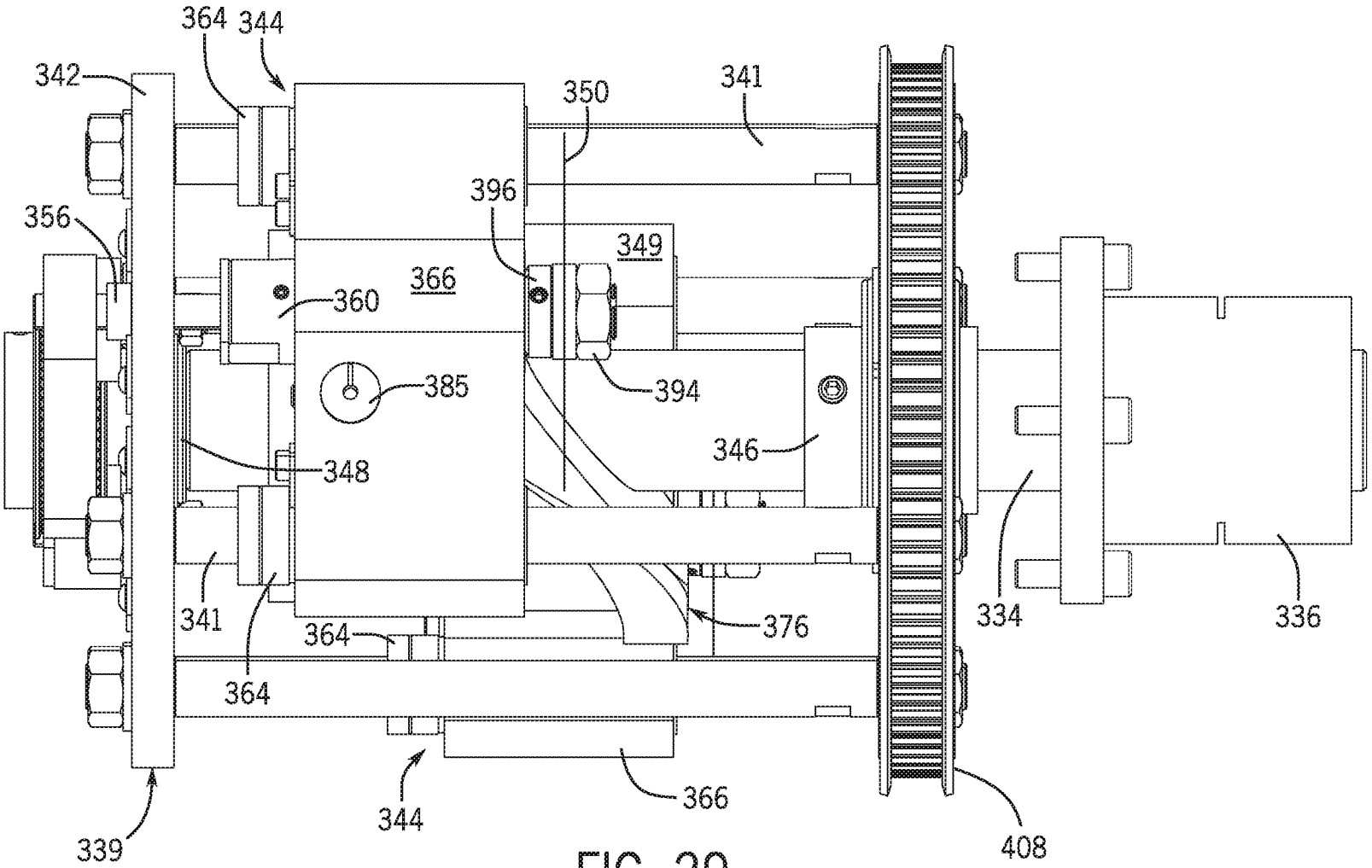
FIG. 29 is a front elevation view of the cutting device shown in FIG. 21, with some elements removed for clarity.
Figure 30:
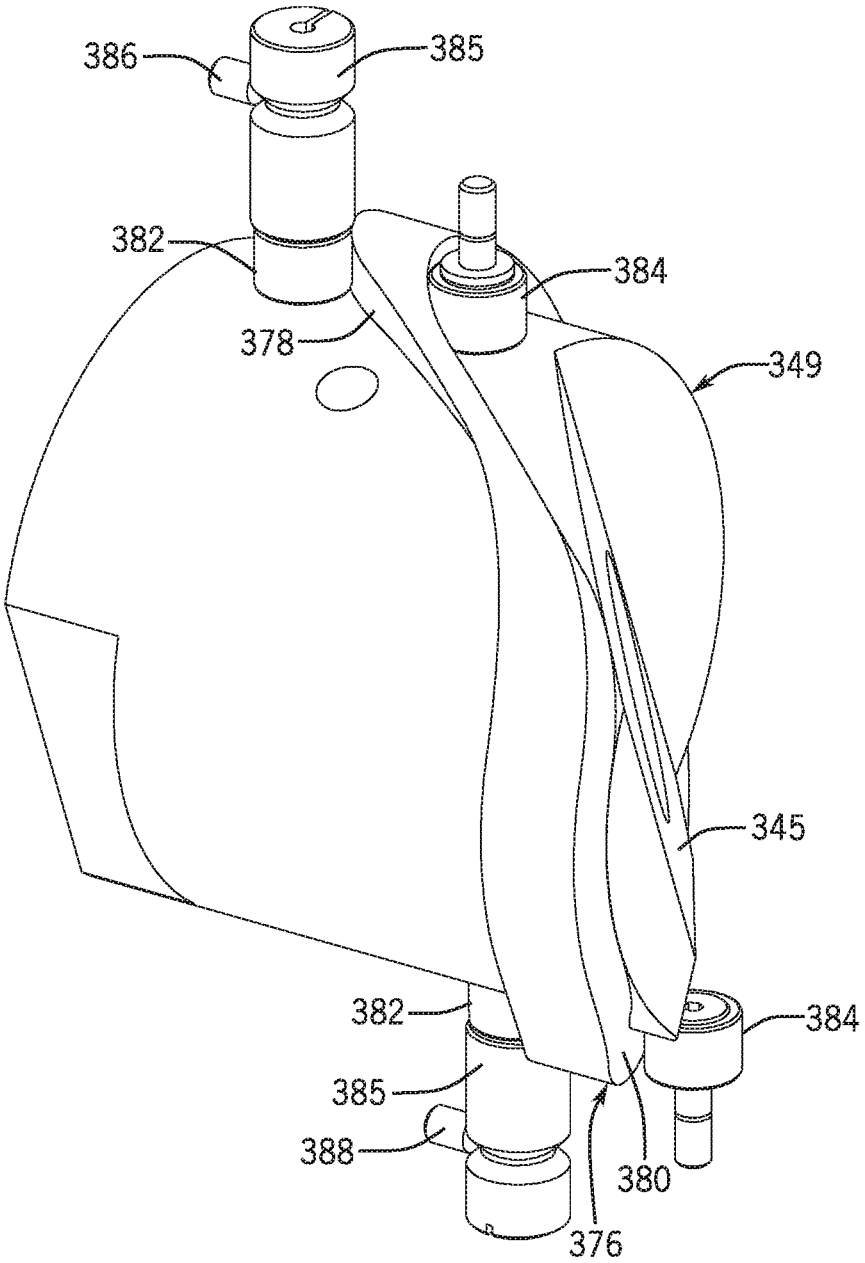
FIG. 30 is a top perspective view of a cam and two sets of cam followers of the cutting device shown in FIG. 21.
Figure 31:
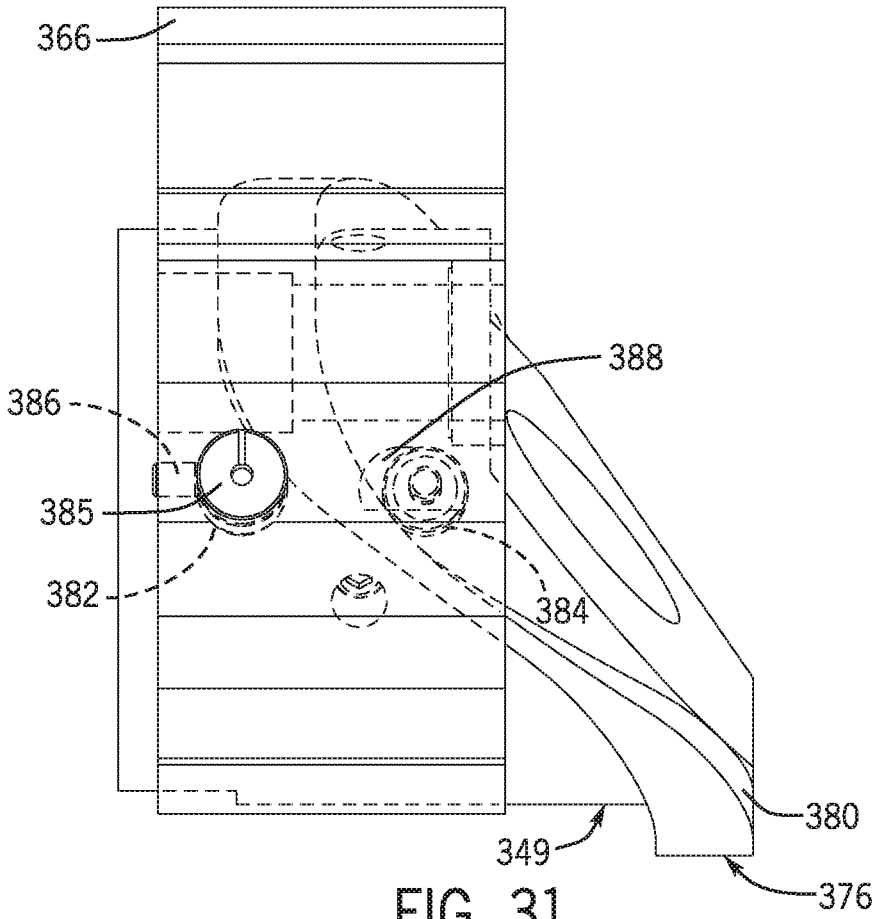
FIG. 31 is a top plan view of the cutting device shown in FIG. 21, with some elements removed for clarity.
Figure 32:
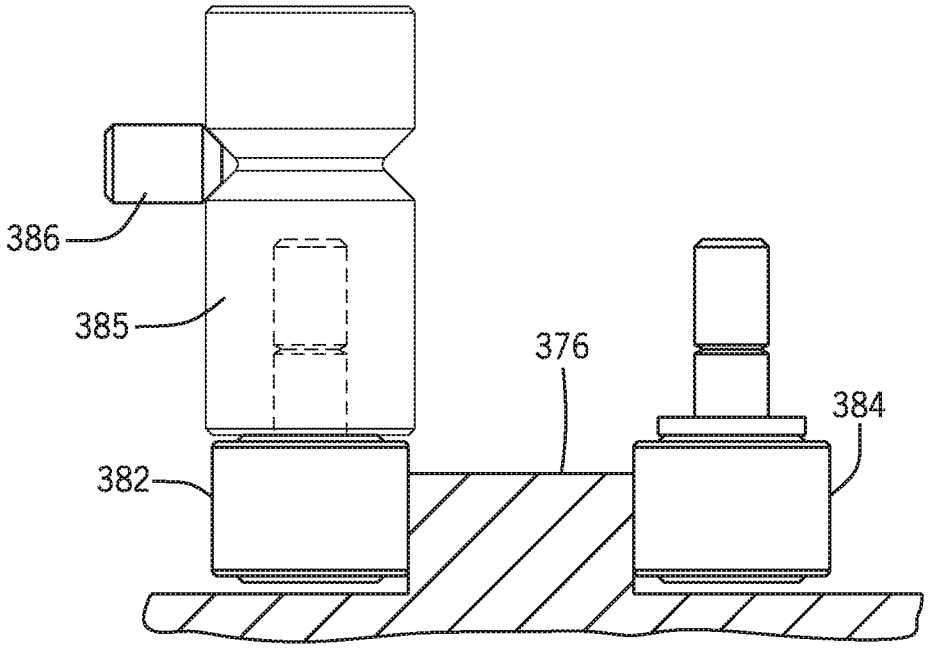
FIG. 32 is an enlarged detail view of the cam and one set of the cam followers shown in FIG. 30 with the cam partially cut away.
Figure 33:
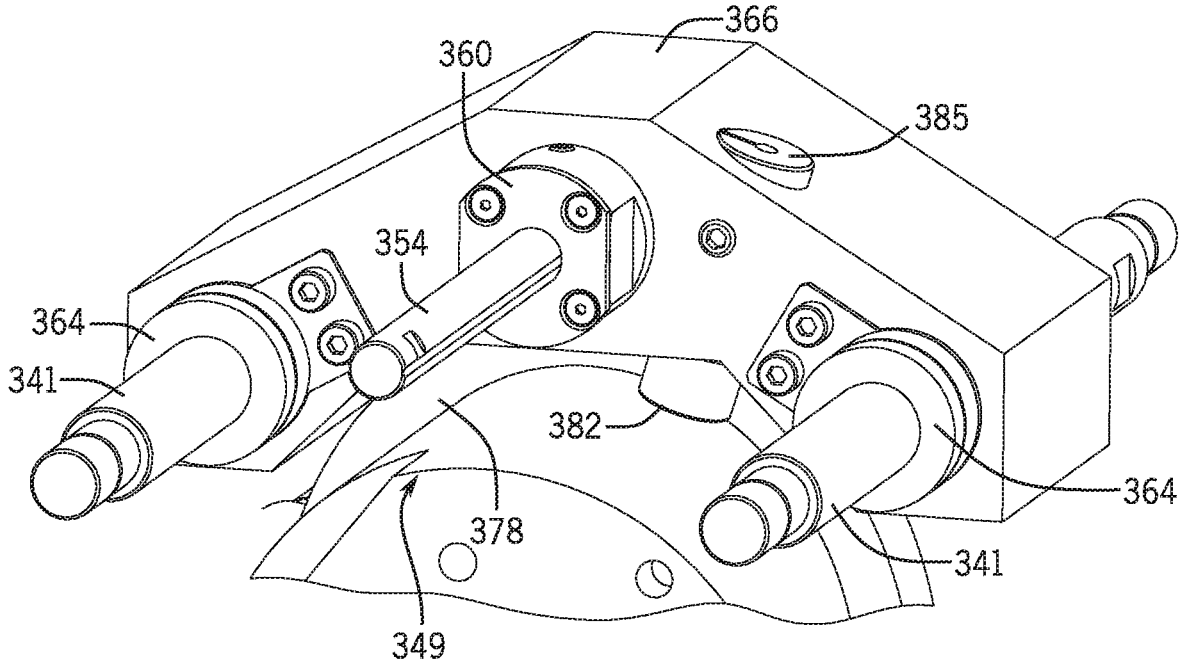
FIG. 33 is a top perspective view of a blade carriage and related components of the cutting device shown in FIG. 21, viewed from the left side, with some elements removed and part of the cam cut away for clarity.
Figure 34:
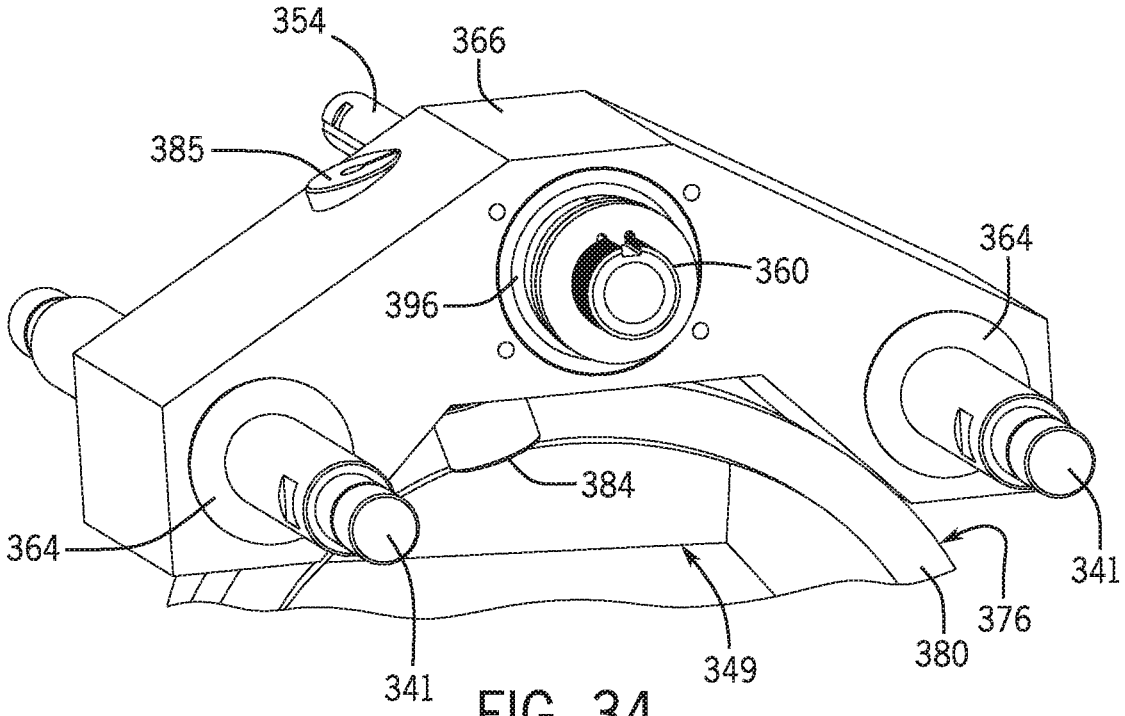
FIG. 34 is a top perspective view of the blade carriage and related components of the cutting device shown in FIG. 21, viewed from the right side, with some elements removed and part of the cam cut away for clarity.

Referring to FIG. 29, the first spool sidewall 340 may be connected to the fixed axle 334 by a bearing 346, such as an ER bearing, and the second spool sidewall 342 may be connected to the fixed axle 334 by a bearing 348, such as a ball bearing, allowing for rotation of the spool frame 339 with respect to the fixed axle 334. In other embodiments, other forms of bearings, or other types of connections, allowing for rotation of the spool frame 339 with respect to the fixed axle 334 are permissible. Additionally, a cam 349, such as a rib barrel cam, may be attached to the fixed axle 334 in a manner fixed against rotation with respect to the fixed axle 334. In the present embodiment, the cam 349 is a rib barrel cam, but in other embodiments, different forms of cams may be employed. As shown best in FIGS. 25 and 30, in this embodiment, the cam 349 has a relief surface 345 carved out of the right side. The relief surface 345 allows the blades 350 to be positioned radially closer to the fixed axle 334 than would be possible in absence of the carved out relief surface 345 without the blades 350 coming into contact with the cam 349 during operation.

Each blade 350 of this embodiment is positioned on the spool frame 339 such that the rotation of the blade spool 338 brings the blade 350 into contact with the tubing 318 when the tubing 318 is in a position to be cut within the tubing guide 322. As shown best in FIG. 24, the tubing guide 322 may form an opening 347 where a given blade 350 requires access to the tubing 318 to cut the tubing 318. In certain embodiments, in particular those in which the direction of blade 150 rotation results in the dispelling of waste in a substantially downward direction, the waste opening 351 may be formed beneath the location where each blade 350 contacts the tubing 318, as shown in the present embodiment. In other embodiments, in particular those in which the direction of blade 150 rotation results in the dispelling of waste in a substantially upward direction, the waste opening may be formed above the location where each blade 350 contacts the tubing 318, as shown in FIGS. 37-38. The waste opening 351 provides access to a waste chute 352 through which waste, such as paper dust, produced during the cutting process, may be dispelled. The waste chute 352 may connect to the support structure 304, for example, when located beneath the cutting location, and may also be configured to connect to a source of vacuum, such as a vacuum hose, to further facilitate the removal of waste from the cutting device 306.

In the embodiment depicted in FIGS. 21-36, each blade 350 is part of a blade assembly 344 that connects to the spool frame 339. In this embodiment, the blade spool 338 includes two blade assemblies 344 connected to the spool frame 339. In other embodiments, a different number of blade assemblies may be connected to the spool frame. For instance, in the embodiments depicted in FIGS. 1-20, the blade spool 138 includes three blade assemblies 144 connected to the spool frame 139. In the present embodiment, each blade assembly 344 includes a blade shaft 354. As shown in FIG. 29, the blade shaft 354 protrudes through the second spool sidewall 342, and is connected to the second spool sidewall 342 by a blade shaft bearing 356. In this embodiment, each blade assembly 344 further includes a blade shaft driven pulley 358 and a sliding member 360, each connected to the blade shaft 354 and each fixed against rotation with respect to the blade shaft 354. As shown in FIG. 36, the sliding member 360 is free to slide along a length of the blade shaft 354. In this embodiment, the sliding member 360 is a spindle, and the spindle is connected to the blade shaft 354 by a spline nut 362. However, in other embodiments, other types of sliding members and other forms of connection that permit sliding of the sliding member 360 with respect to the blade shaft 354 are permissible.

The blade 350 may be positioned on the sliding member 360, the plane of the blade 350 normal to the longitudinal axis of the sliding member 360. The blade 350 may further be fixed against rotation with respect to the sliding member 360. In the present embodiment, a collar 396 (FIG. 29) is affixed to the sliding member 360, and the blade 350 is secured to the sliding member 360 by a pair of keyed washers 392, connected to the sliding member 360 on either side of the blade 350, and a blade nut 394, screwed onto the sliding member 360 such that the blade 350 and keyed washers 392 are locked in position against collar 396.

Further included in the blade assembly 344 is at least one bushing 364. In this embodiment, each blade assembly 344 includes two bushings 364, each connected to one of the guide rods 341 in a manner that permits sliding along the respective guide rod 341. A blade carriage 366 connects the sliding member 360 to the bushings 364, and thereby, in effect, connects the blade 350 slidably to the guide rods 341.

Figure 35:
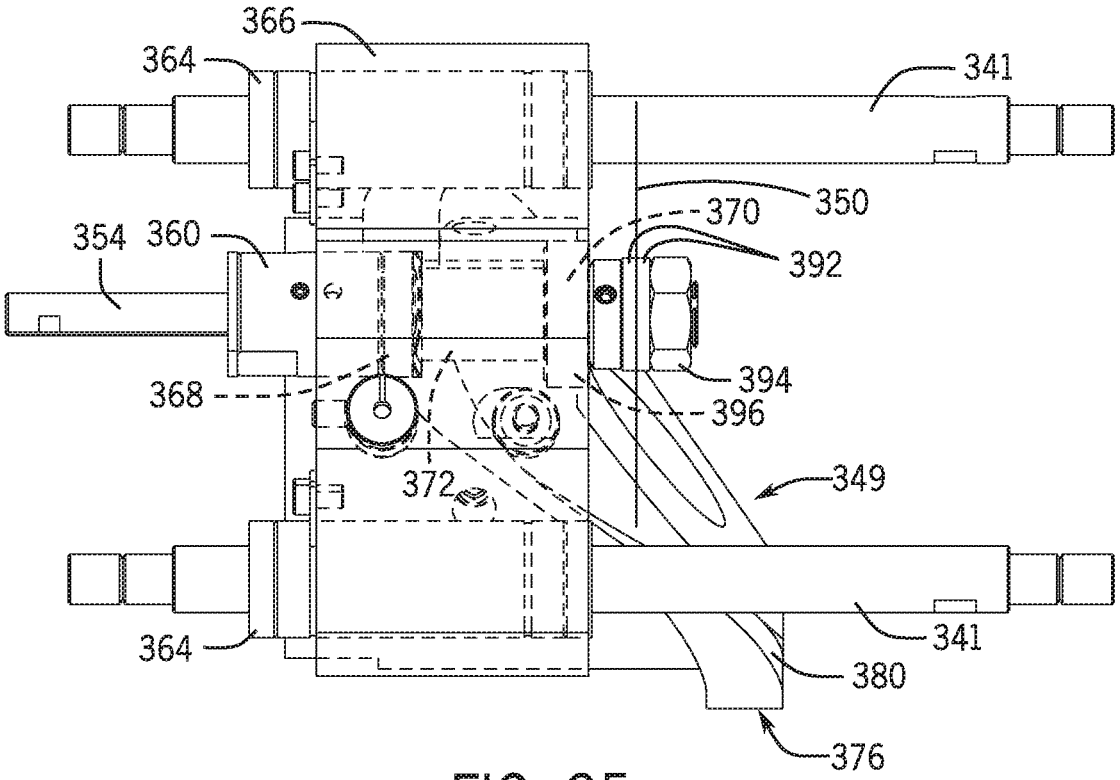
FIG. 35 is a top plan view of the cutting device shown in FIG. 21, with some elements removed for clarity.
Figure 36:
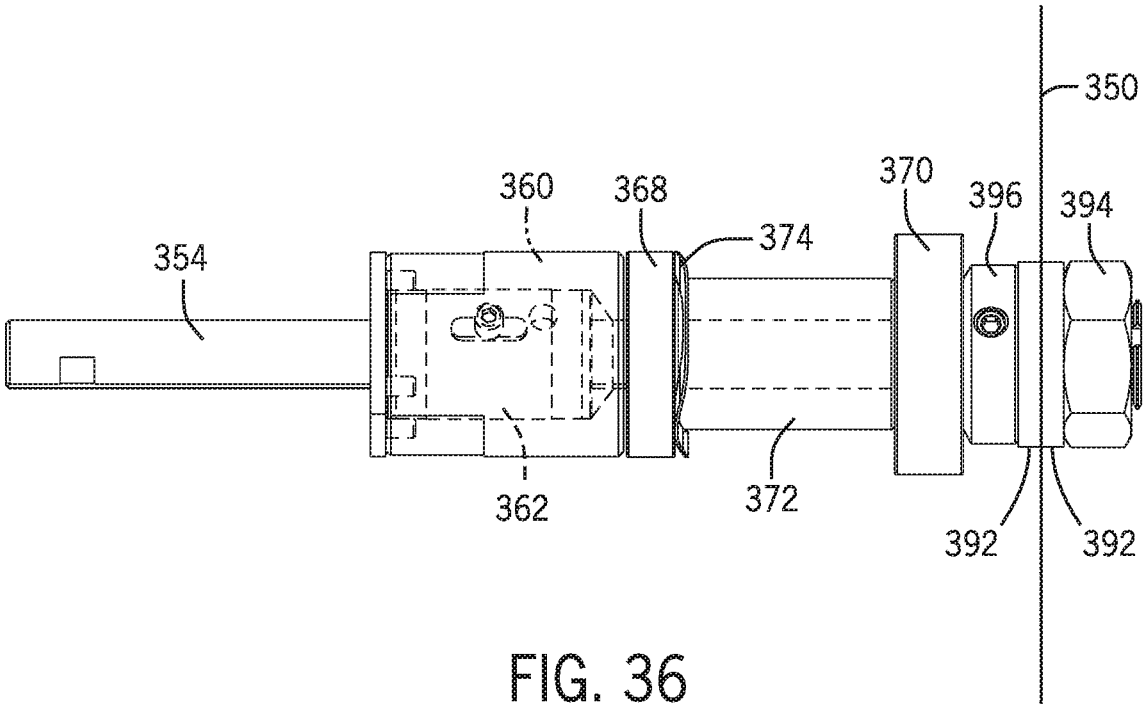
FIG. 36 is a top plan view of a blade shaft and related components of the cutting device shown in FIG. 21.

Referring now to FIGS. 35 and 36, in this embodiment, the blade carriage 366 includes a first blade carriage bearing 368 and a second blade carriage bearing 370, separated by a bearing spacer 372, which permit the sliding member 360 to rotate with respect to the blade carriage 366 when the blade shaft 354 rotates. A wave spring 374 may be positioned between the first blade carriage bearing 368 and the bearing spacer 372 to absorb intermittent shock loads and compensate for any internal expansion or contraction between the first blade carriage bearing 368 and the second blade carriage bearing 370. The presence of the wave spring 374 permits higher manufacturing tolerances with respect to the corresponding parts and compensates for wear.

Referring now mainly to FIGS. 30-34, each blade assembly 344 includes at least one cam follower. In the present embodiment, a rib 376 having a first rib face 378 and oppositely facing second rib face 380 is defined along the surface of the cam 349. In this embodiment, the blade assembly 344 includes a first cam follower 382, connected to the blade carriage 366 and bearing on the first rib face 378, and a second cam follower 384, connected to the blade carriage 366 and bearing on the second rib face 380. The first and second cam followers 382, 384 are connected to the blade carriage 366 in a manner that permits rotation of the cam followers 382, 384 with respect to the blade carriage 366 when the first and second cam followers 382, 384 are respectively moved along the first and second rib faces 378, 380, that is, as the blade carriage 366 moves along the rib 376. In the present embodiment, the first cam follower 382 is connected to a lash adjuster 385, which is connected to a set screw 386. Adjustment of lash adjuster 385, prior to operation, may be accomplished by rotating the lash adjuster 385 until the first cam follower 382 is brought into contact with the first rib face 378, at which point the adjustment may be fixed in place by tightening the set screw 386. The second cam follower 384 may be permitted slight lateral movement with respect to the blade carriage 366, confined to an opening 388 formed within the interior of the blade carriage 366, to compensate for minor irregularities in the spacing between the rib faces 378, 380.

In the embodiment shown in FIGS. 21-36, the cutting device 306 further includes a servo motor 400. As shown best in FIG. 26, the servo motor 400 includes a servo shaft 402 that connects to a first driving pulley 403. A first timing belt 406 may be secured about the first driving pulley 403 and a spool driven pulley 408. In the present embodiment, the spool driven pulley 408 is formed by the outer edge of the first spool sidewall 340. Thereby, the servo motor 400 controls the rotation of the blade spool 338.

Figure 24:
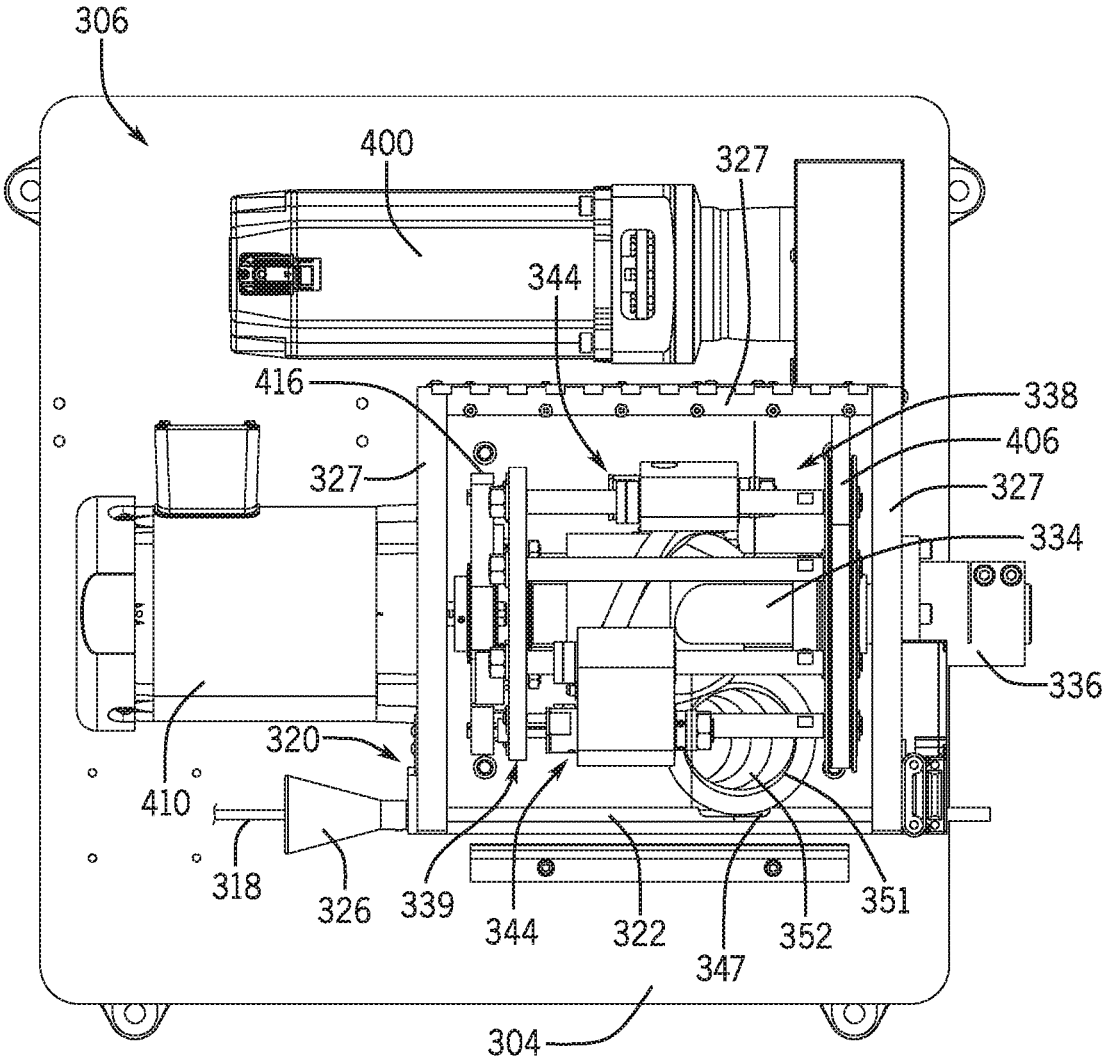
FIG. 24 is a top plan view of the cutting device shown in FIG. 21.
Figure 25:
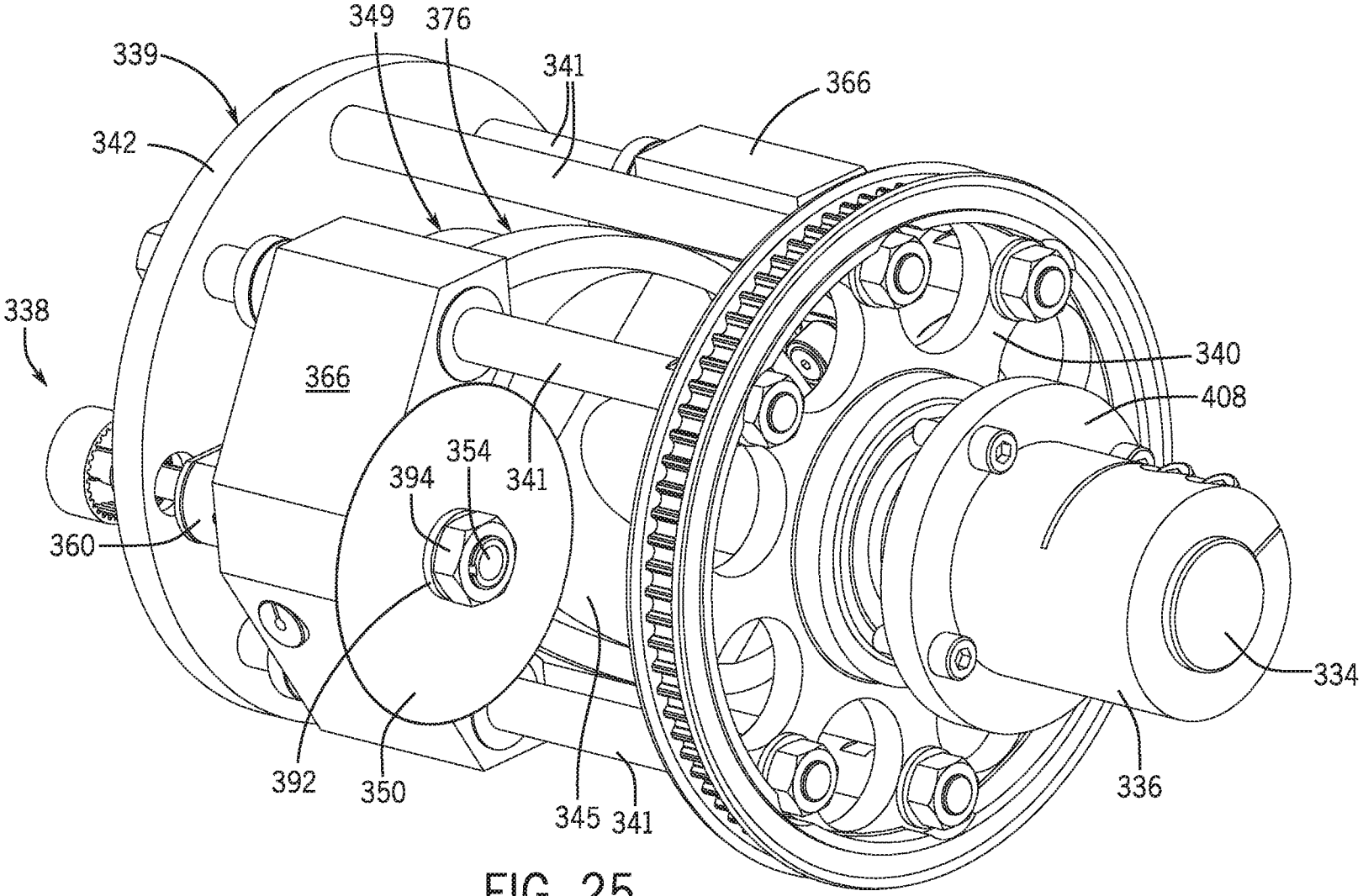
FIG. 25 is a top perspective view of the cutting device shown in FIG. 21, viewed from the right side, with some elements removed for clarity.
Figure 26:
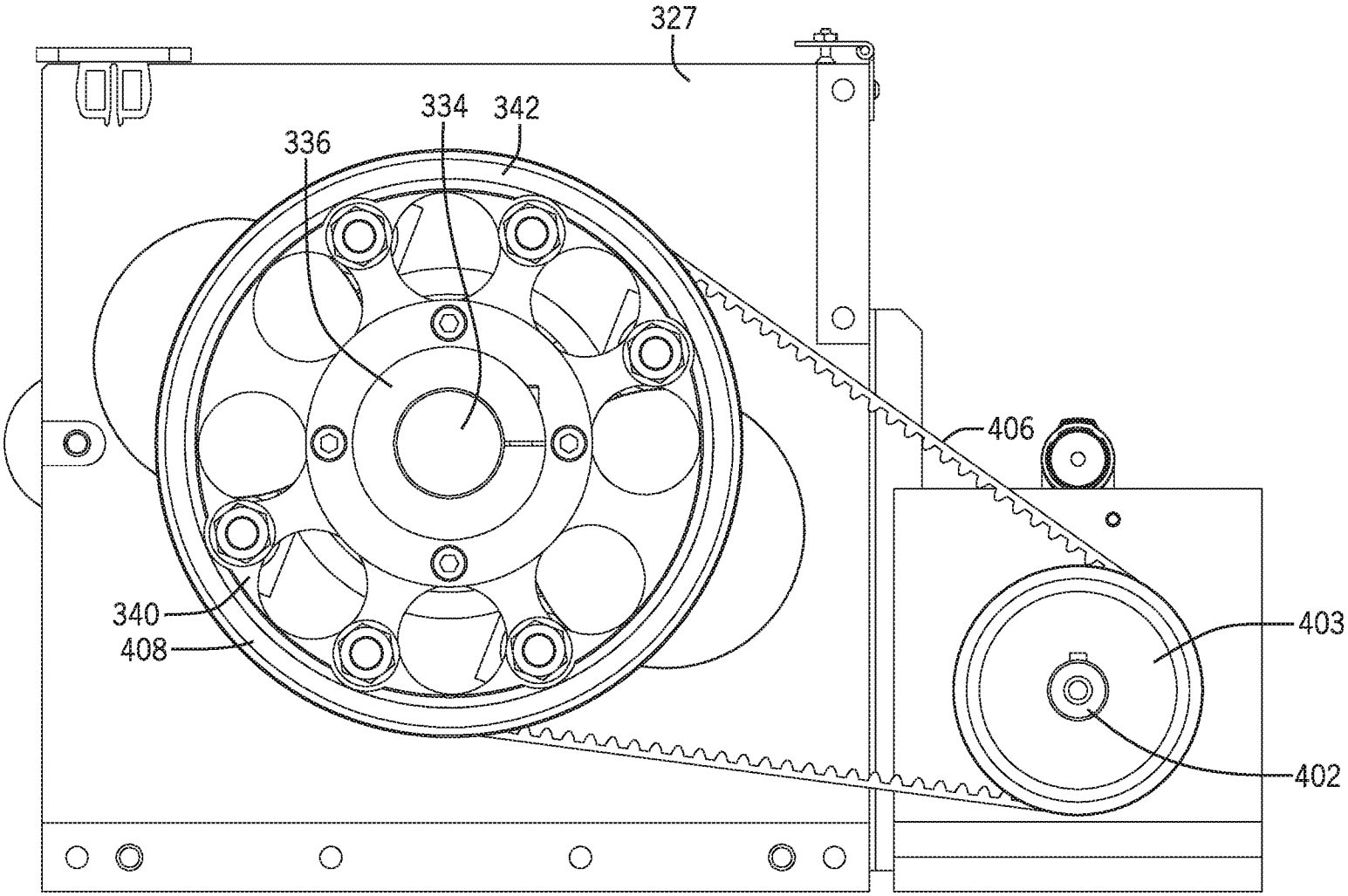
FIG. 26 is a right side elevation view of the cutting device shown in FIG. 21, with some elements removed for clarity.
Figure 27:
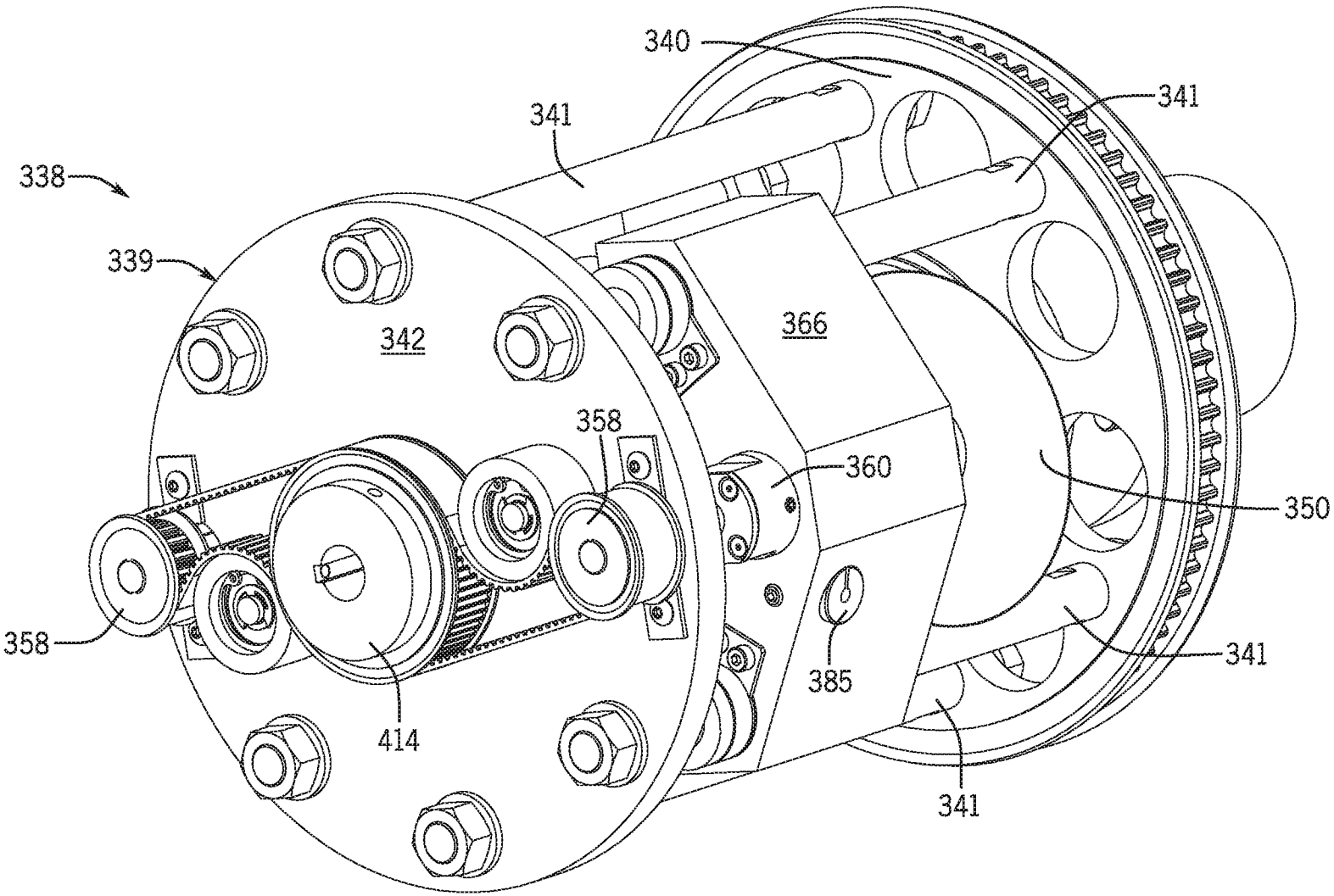
FIG. 27 is a top perspective view of the cutting device shown in FIG. 21, viewed from the left side, with some elements removed for clarity.
Figure 28:
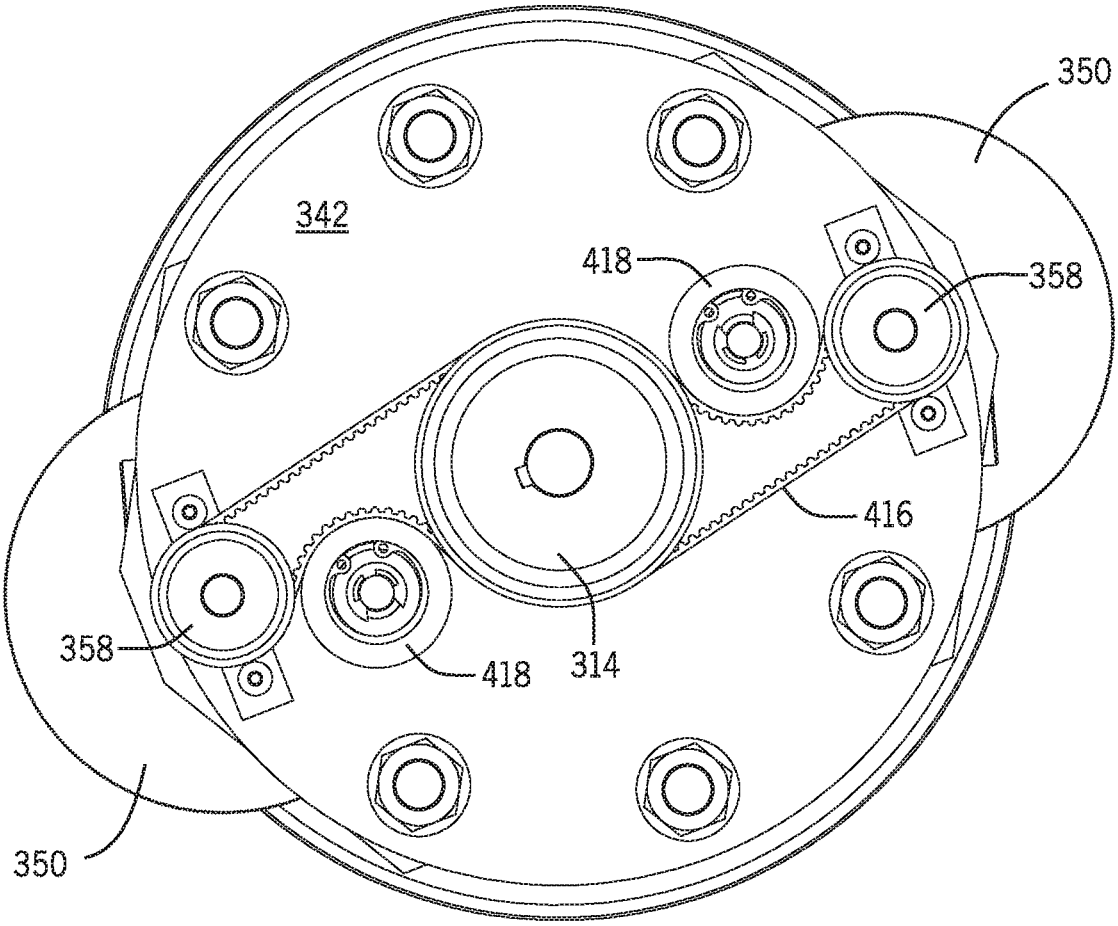
FIG. 28 is a left side elevation view of the cutting device shown in FIG. 21, with some elements removed for clarity.

Looking mainly at FIGS. 24 and 27-28, the cutting device 306 of the present embodiment further includes a blade drive motor 410. The blade drive motor 410 includes a blade drive shaft 412 that connects to a second driving pulley 414. A second timing belt 416 is engaged about the second driving pulley 414 and each of the blade shaft driven pulleys 358. In certain embodiments, one or more idler or tensioner pulleys 418 may be connected to the second spool sidewall 342 and positioned to add tension to the second timing belt 416. In the present embodiment, two idler pulleys 418 are utilized. However, in other embodiments, a different number of idler pulleys 418 may be utilized. For instance, in the embodiment shown in FIGS. 1-20, only a single idler pulley 218 is utilized.

Figure 21A:
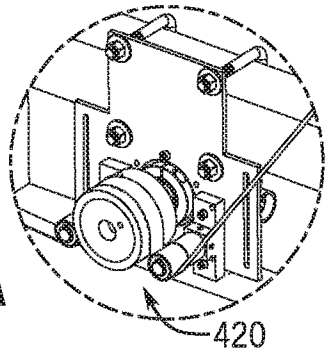
FIG. 21A is an enlarged detail view of the encoder shown in FIG. 21.
Figure 22:
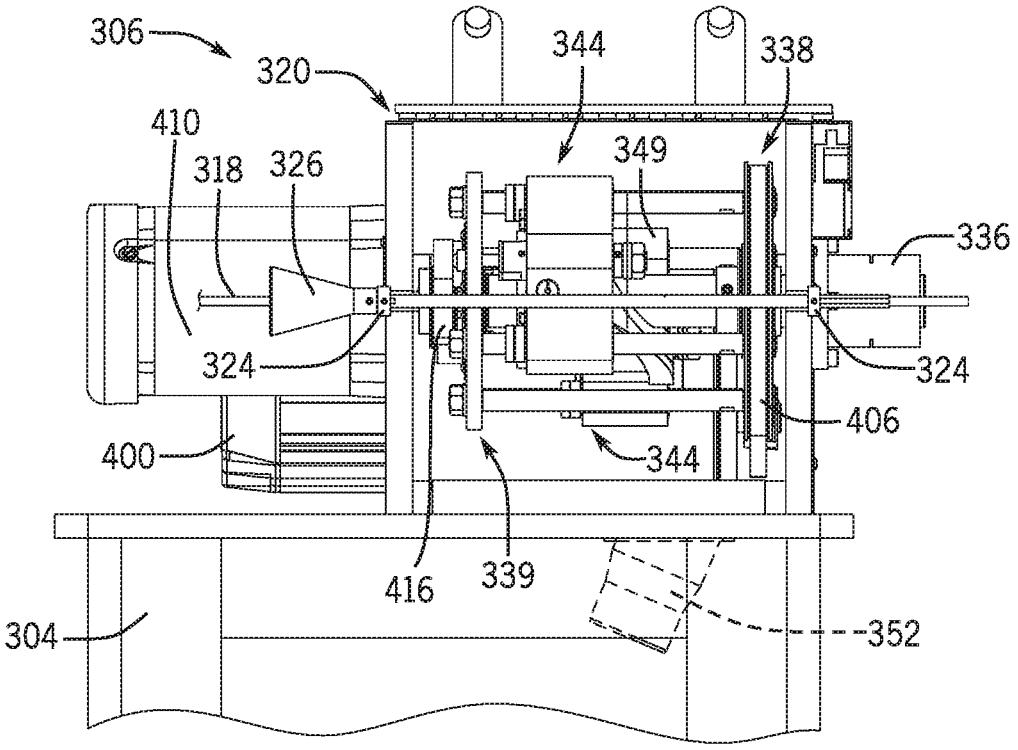
FIG. 22 is a front elevation view of the cutting device shown in FIG. 21.
Figure 23:
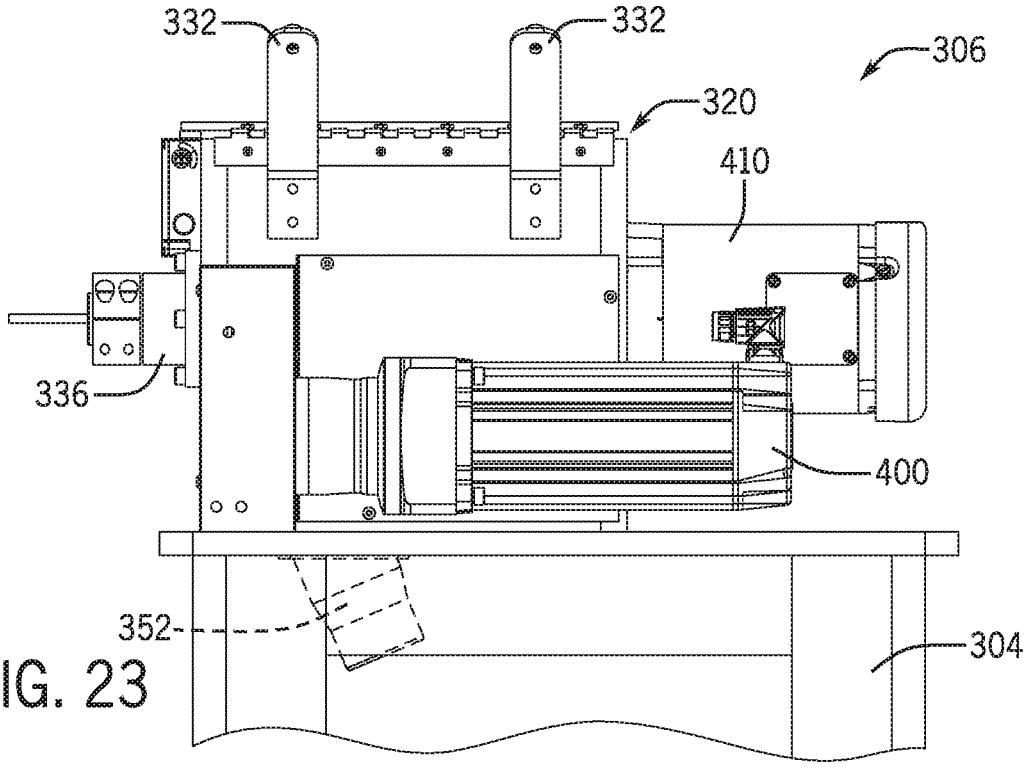
FIG. 23 is a rear elevation view of the cutting device shown in FIG. 21.

As shown best in FIG. 21-21A, the system 300 further includes an encoder 420 that communicates with the servo motor 400 to establish appropriate accelerations or decelerations of the blade spool 338 rotational speed based on the speed at which the tubing 318 is formed in the winding device 302 and fed through the cutting device 306. The control monitor 308 may include advance and retard controls, which respectively allow the operator to make manual adjustments to the blade spool 338 rotational speed established by the communication between the servo motor 400 and the encoder 420. Additionally, the control monitor 308 may include an emergency stop control 404 and a power control 405. In this embodiment, the emergency stop and power controls 404, 405 are external buttons.

During operation of the system 300, the winding device 302 winds a material into the tubing 318. In this embodiment, the material may be comprised of paper. The tubing 318 is then transferred to the cutting device 306. In this embodiment, the winding device 302 moves the tubing 318 continuously along the angle guide 310, into the funnel 326, and then through the tubing guide 322, where the tubing 318 is cut to a desired straw length.

In this embodiment, the tubing 318 is cut to a desired straw length by rotating the blade 350 of each blade assembly 344 about a central axis of the blade 350 while revolving each blade assembly 344 about the central axis of the blade spool 338, such that each blade 350 is sequentially brought into contact with the tubing 318 when the tubing 318 is moved into a proper position to be cut, and sliding the blade 350 in a direction coinciding with the direction in which the tubing 318 is moving, at least while the tubing 318 is being cut. In the present embodiment, there are two blade assemblies 344, each revolving about the central axis of the blade spool 338 and sequentially cutting a desired straw length of the tubing 318. A commonly desired straw length is approximately 8 inches. However, the system 300 may be calibrated to cut straws of other lengths, as well.

To accomplish the rotation of the blade 350, according to the present embodiment, the blade drive motor 410 rotates the blade drive shaft 412, which in turn rotates the second driving pulley 414. The second driving pulley 414, when rotated, applies a force to the second timing belt 416 sufficient to move the timing belt in a manner that likewise rotates each blade shaft driven pulley 358. The rotation of each blade shaft driven pulley 358 rotates each respective blade shaft 354 and likewise, each respective blade 350. Each blade 350 in this embodiment is rotated at a substantially constant speed of approximately 7500 rpm. However, other rotational speeds may be used.

In the embodiment shown in FIGS. 21-36, each blade assembly 344 is revolved around the central axis of the blade spool 338 through rotation of the spool frame 339, to which each blade assembly 344 is connected. To rotate the spool frame 339 of the present embodiment, the servo motor 400 rotates the servo shaft 402, which in turn rotates the first driving pulley 403. The first driving pulley 403, when rotated, applies a force to the first timing belt 406 sufficient to move the timing belt in a manner that likewise rotates the spool driven pulley 408. The rotation of the spool driven pulley 408 rotates the spool frame 339. The rotational speed of the blade spool 338 varies. To establish the rotational speed pattern of the blade spool 338, the encoder 420 of the winding device 302 transfers signals to the servo motor 400 related to the speed at which the tubing 318 is moving through the cutting device 306 and appropriate accelerations or decelerations to the rotational speed of the blade spool 338, accordingly. Furthermore, when necessary to promote smoother rotation of the blade spool 338, the operator may manually accelerate or decelerate the rotational speed of the blade spool 338 using the control monitor 308. A smoother rotation of the blade spool 338 may result in cleaner cuts of the tubing 318, with fewer jagged edges resulting from a given cut.

The sliding of the blade 350 is accomplished in this embodiment by the cam followers 382, 384 bearing along the rib 376 as the blade spool 338 rotates. In this embodiment, the first cam follower 382 bears along the first rib face 378, and the second cam follower 384 coincidingly bears along the second rib face 380 as the blade spool 338 rotates and the cam 349 remains stationary with respect to the device frame 320. In the present embodiment, to cut an 8 inch straw, the blade 350 contacts the tubing 318 for a distance of approximately 1.00-1.25 inches as the cut is made. In other embodiments, this distance may vary based on factors such as the desired straw length, the speed with which tubing 318 moves through the tubing guide 322, the rotational speed of the blade spool 338 and blades 350, etc. The sliding of the blade 350 as the blade 350 cuts through the tubing 318 allows the blade 350 to make a clean cut without the need to stop the movement of the tubing 318 through the tubing guide 322 and/or the rotation of the blade spool 338.

Finally, the cutting of the tubing 318 with the blade 350 may produce waste, such as dust and tubing material clippings. According to certain embodiments, a source of vacuum, such as a vacuum hose, connected to the waste chute 352 may draw such waste through the waste chute 352 and out of the cutting device 306. The direction in which the waste is substantially dispelled may vary depending on the rotational direction of the blade 350. For instance, in an embodiment in which the blade 350 is rotated in a forward direction, the waste may be substantially dispelled in a downward direction. In such an embodiment, it may be beneficial to remove the waste from below the cutting location, as shown in the configuration of the present embodiment. Alternatively, in an embodiment in which the blade 350 is rotated in a rearward direction, the waste may be substantially dispelled in an upward direction. In such an embodiment, it may be beneficial to remove the waste from above the cutting location, as shown in the embodiment illustrated in FIGS. 37-38.

FIGS. 37-45 show a third embodiment of a system 500 for cutting straws. Referring to FIGS. 37-38, perspective views of a system 500 are provided, as described above. For reference, a rear 501, a right side 503, a left side 505, and a front 507 are identified in FIG. 37.

In the embodiment shown in FIGS. 37-38, the system 500 includes a winding device 502, a support structure 504, a cutting device 506, a control monitor 508, an angle guide 510, and an encoder 620. In the present embodiment, the cutting device 506 is directly mounted to the support structure 504. The control monitor 508 is mounted to the support structure 504 by a monitor support member 512, and the angle guide 510 is mounted to the support structure 504 by a first angle guide support 514 and a second angle guide support 516. In alternative embodiments, alternative means of supporting the cutting device 506, control monitor 508, and angle guide 510 may be permissible. In the present embodiment, the angle guide 510 is sized to guide a tubing 518 formed by the winding device 502 to the cutting device 506. In some embodiments, the tubing 518 is comprised of paper.

In this embodiment, the cutting device 506 includes a frame 520 and a tubing guide 522 protruding through the frame 520 and connected to the frame 520 by tubing guide clamps 524. Attached to the tubing guide 522 and positioned adjacent to the angle guide 510 is a funnel 526 sized to receive the tubing 518 and transfer the tubing 518 from the angle guide 510 to the tubing guide 522. In the present embodiment, the funnel 526 and the tubing guide 522 are sized to receive jumbo drinking straw tubing, having a diameter of approximately ¼ inch. However, in other embodiments, other funnel and tubing guide sizes may be employed to accommodate alternatively sized tubing. For instance, in alternative embodiments, a funnel and tubing guide may be utilized that are sized to receive giant drinking straw tubing, having a diameter of approximately 5/16 inch, colossal drinking straw tubing, having a diameter of approximately 7/16 inch, boba drinking straw tubing, having a diameter of approximately ½ inch, cocktail straw tubing, having a diameter of approximately 3/16 inch, etc.

The cutting device frame 520 may include a plurality of interconnected frame panels 527, one or more of which may form a door 528, being moveable from an open position, permitting operator access to internal components of the frame 520, to a closed position, preventing operator access to the internal components of the frame 520. In the embodiment shown in FIGS. 37-38, the door 528 includes a handle 530 that may be grasped by an operator to lift the door 528 into an open position. In some embodiments, the door 528 may be comprised of a transparent material, such as glass, allowing the operator to view internal operations of the cutting device 506 during operation. In certain embodiments, as shown in FIG. 38, the door 528 may rest on door stops 532 when in the open position. Door stops 532 permit the door 528 to remain in the open position while an operator makes adjustments within the cutting device 506.

FIGS. 39-45 show a series of views of the cutting device 506 of the system 500 and various parts thereof. In this embodiment, a fixed axle 534 passes through the frame 520 and is affixed to the frame 520 by a shaft support 536. In other embodiments, other means of affixing the fixed axle 534 to the frame 520 may be employed.

Figure 39:
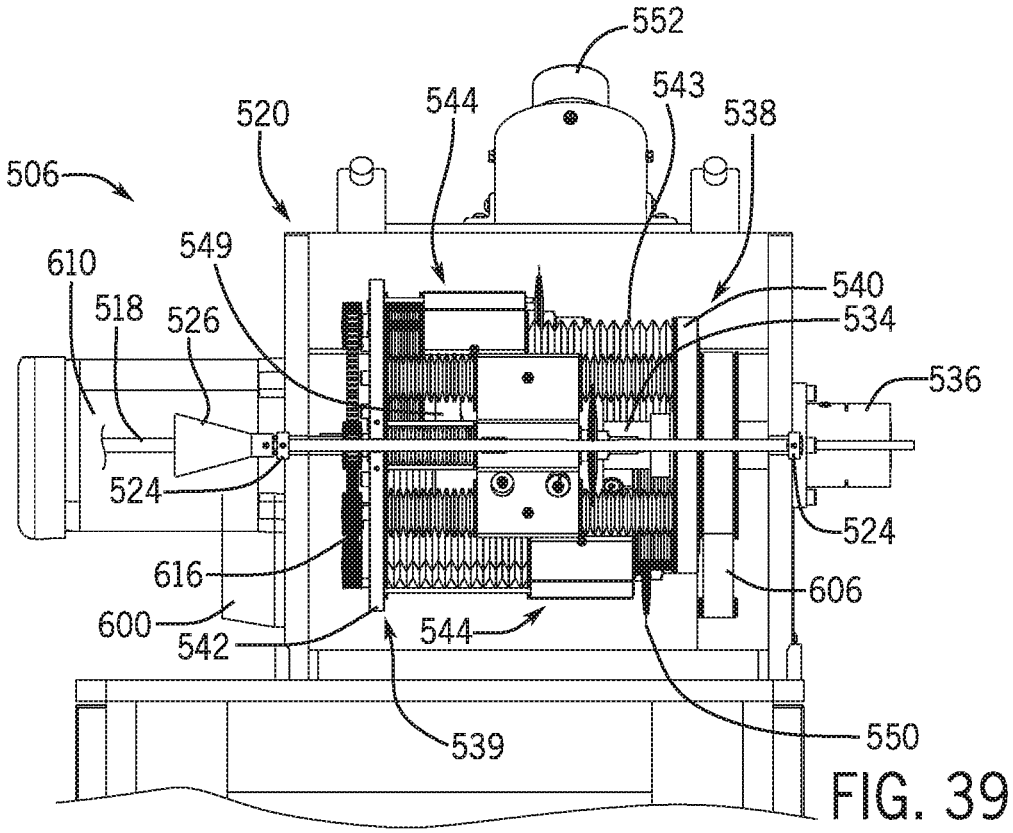
FIG. 39 is a front elevation view of the cutting device shown in FIG. 37.
Figure 40:
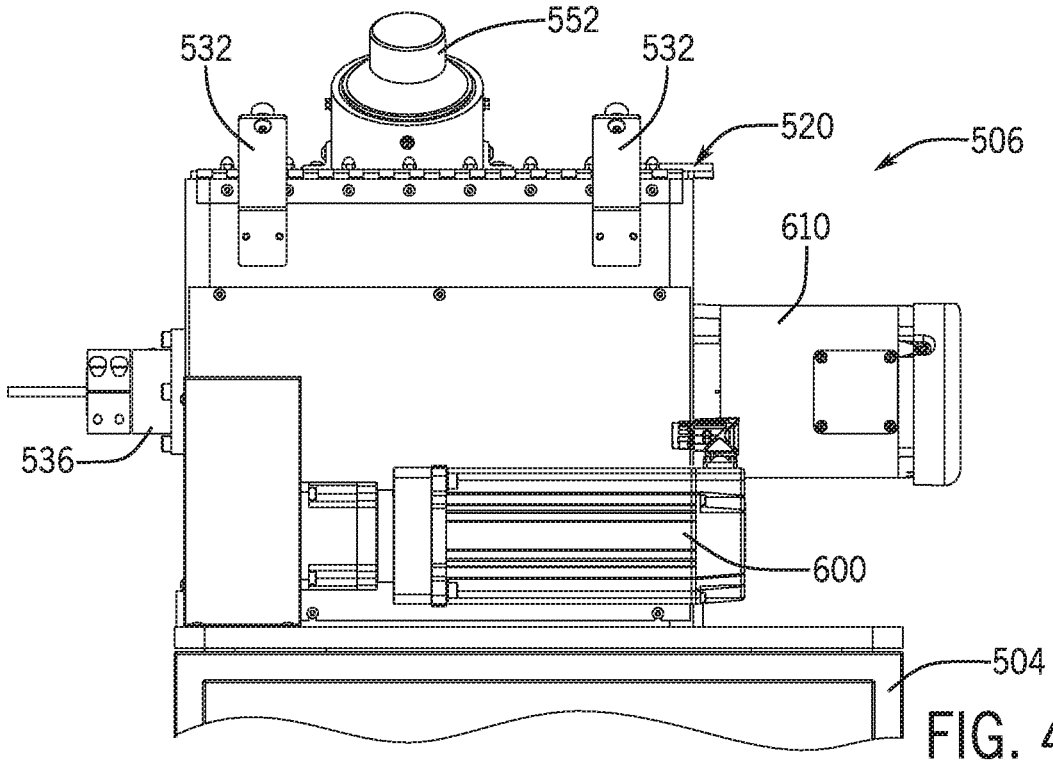
FIG. 40 is a rear elevation view of the cutting device shown in FIG. 37.

A blade spool 538 is connected to the fixed axle 534 in a manner that allows rotation of the blade spool 538 about the fixed axle 534. In this embodiment, the fixed axle 534 is positioned coaxial with a central axis of the blade spool 538. In the present embodiment, the blade spool 538 includes a spool frame 539 and at least one blade 550 connected to the spool frame 539. Here, the spool frame 539 includes a first spool sidewall 540, a second spool sidewall 542, parallel to and spaced apart from the first spool sidewall 540, and a plurality of guide rods 541 (not shown in FIG. 39, but see FIGS. 44-45) extending between the first spool sidewall 540 and the second spool sidewall 542. Referring to FIG. 39, the guide rods 541 may be covered by bellow-type dust covers 543 to protect the guide rods 541 from waste that may be generated by the straw cutting process.

In the present embodiment, the first spool side wall 540 and the second spool sidewall 542 are connected to the fixed axle 534 in an identical way to that in which the first spool sidewall 140 and second spool sidewall 142 are connected to the fixed axle 134, as shown and described in the first embodiment above, particularly with reference to FIG. 13.

Each blade 550 is positioned on the spool frame 539 such that the rotation of the blade spool 538 brings the blade 550 into contact with the tubing 518 when the tubing 518 is in a position to be cut within the tubing guide 522. Although not shown, the tubing guide 522 includes an identical opening to the opening 147 in the tubing guide 122 described in the first embodiment above and shown in FIG. 7. In some embodiments, a waste chute 552, may be connected to the cutting device 506, where a waste opening has been formed. Waste, such as paper dust, produced during the cutting process, may be dispelled through the waste chute 552. In certain embodiments, in particular those in which the direction of blade 150 rotation results in the dispelling of waste in a substantially downward direction, the waste chute 552 may be positioned beneath the location where each blade 550 contacts the tubing 518. In other embodiments, in particular those in which the direction of blade 150 rotation results in the dispelling of waste in a substantially upward direction, the waste chute 552 may be positioned above the location where each blade 550 contacts the tubing 518, as shown in the present embodiment, particularly in FIGS. 37-38. The waste chute 552 may be configured to connect to a source of vacuum, such as a vacuum hose, to further facilitate the removal of waste from the cutting device 506. Additionally, a waste hood 622 may protrude from the waste chute 552 in the direction of the tubing 518 to create a more streamlined path for dust removal. In the present embodiment, the waste hood 622 extends to a vent 624 in one of the frame panels 527.

In the embodiment depicted in FIGS. 37-45, each blade 550 is part of a blade assembly 544 that connects to the spool frame 539. In this embodiment, as in the embodiment shown in FIGS. 1-20, the blade spool 538 includes three blade assemblies 544 connected to the spool frame 539. In other embodiments, a different number of blade assemblies may be connected to the spool frame. For instance, in the embodiment depicted in FIGS. 21-36, the blade spool 338 includes two blade assemblies 344 connected to the spool frame 339.

In the present embodiment, each blade assembly 544 includes a blade shaft 554 that protrudes through the second spool sidewall 542, normal to the second spool sidewall 542. The blade shaft 554 is connected to the second spool sidewall 542 in the same manner as described in the first embodiment above and shown at least in FIG. 13. Additionally, the blade shaft 554 is rotated by the same means as shown and described with respect to the first embodiment, with an identical combination of a timing belt with idler, blade shaft driving, and blade shaft driven pulleys, shown at least in FIGS. 10-12, the blade driven pulley still rotated by a blade drive motor 610. However, during ordinary operation, the blade drive motor 610 may rotate the blade shaft driving pulley of the present embodiment in an opposite direction to that in which the blade drive motor 210 rotates the blade shaft driving pulley 158 of the first embodiment, ultimately causing the blades 550 to rotate in an opposite direction to that in which the blades 150 of the first embodiment are rotated. In the present embodiment, each blade 550 is rotated in a rearward direction, as each blade 550 is revolved in a forward direction. Rearward rotation of the blades 550, in combination with forward revolution of the blades 550, can lead to smoother cuts of the tubing 518.

Figure 44:
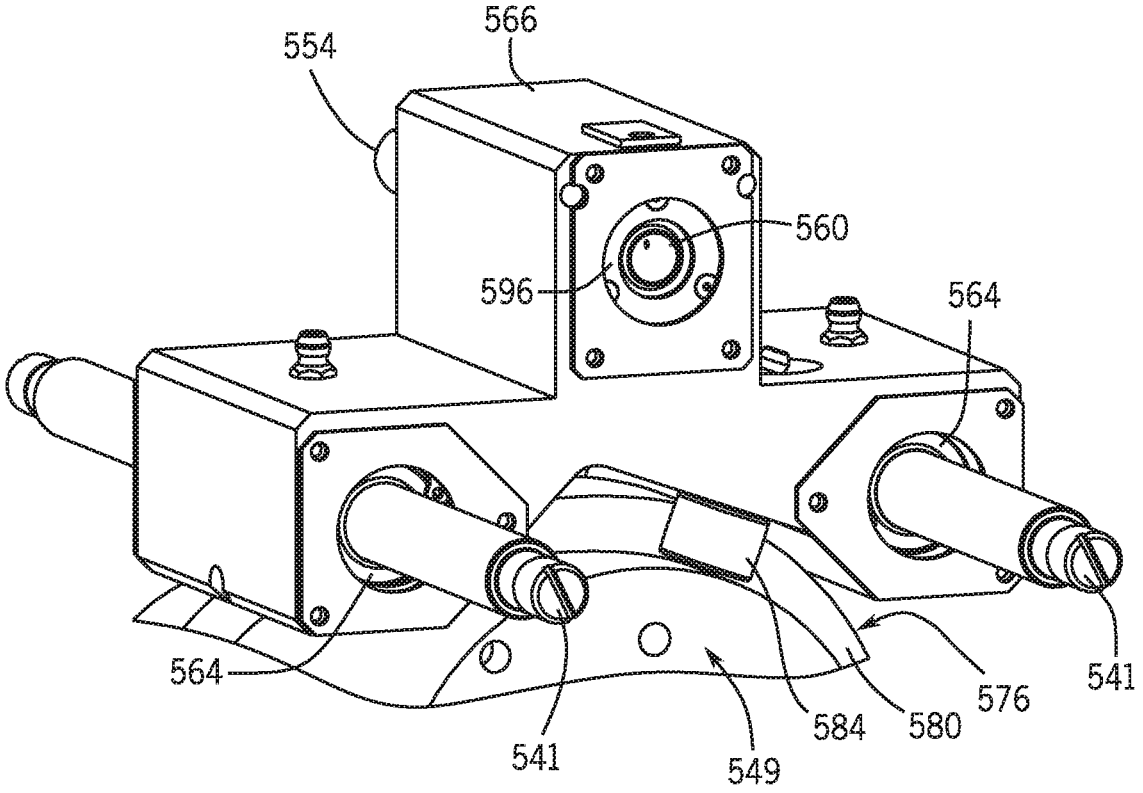
FIG. 44 is a top perspective view of a blade carriage and related components of the cutting device shown in FIG. 37 viewed from the left side, with some elements removed and part of the cam cut away for clarity.
Figure 45:
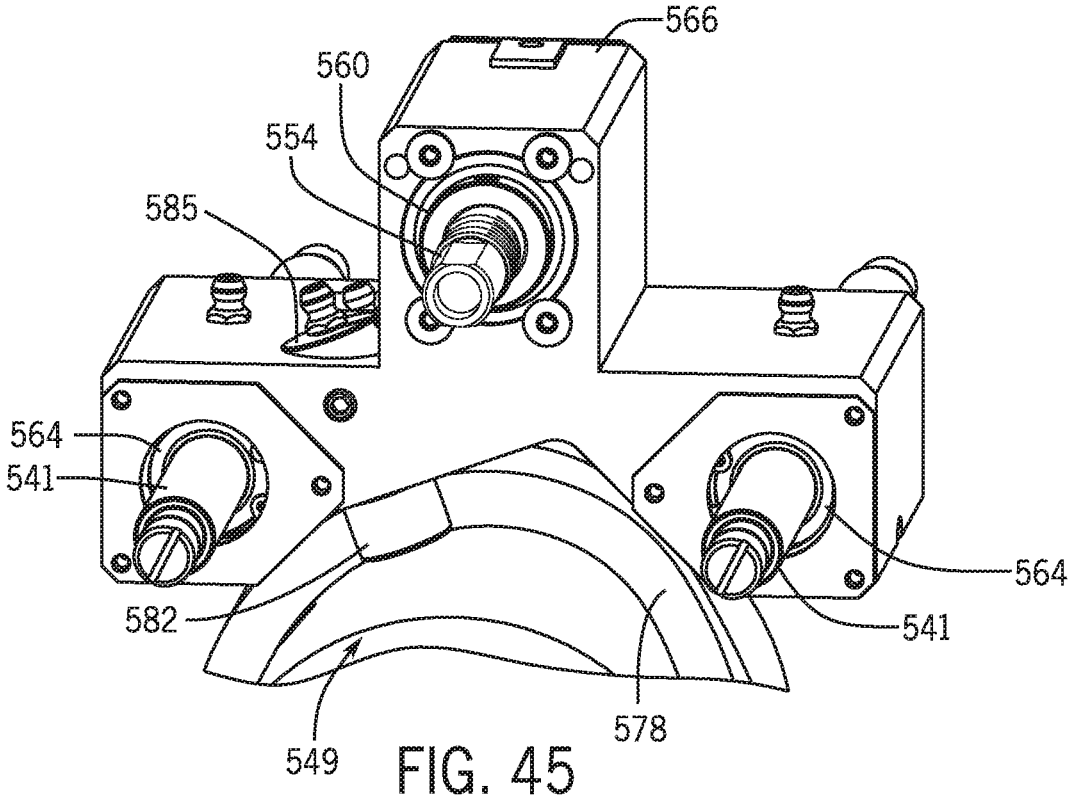
FIG. 45 is a top perspective view of the blade carriage and related components of the cutting device shown in FIG. 37, viewed from the right side, with some elements removed and part of the cam cut away for clarity.

In this embodiment, each blade assembly 544 is configured identically to the blade assembly 144 of the first embodiment, as described above and shown at least in FIGS. 19-20, with only slight variations to the size and shape of certain parts that do not impact overall function. The sliding member 560 shown in FIGS. 44-45 is still free to slide along the length of the blade shaft 554. Other types of sliding members and other forms of connection that permit sliding of the sliding member 560 with respect to the blade shaft 554 may also be permissible.

Figure 41:
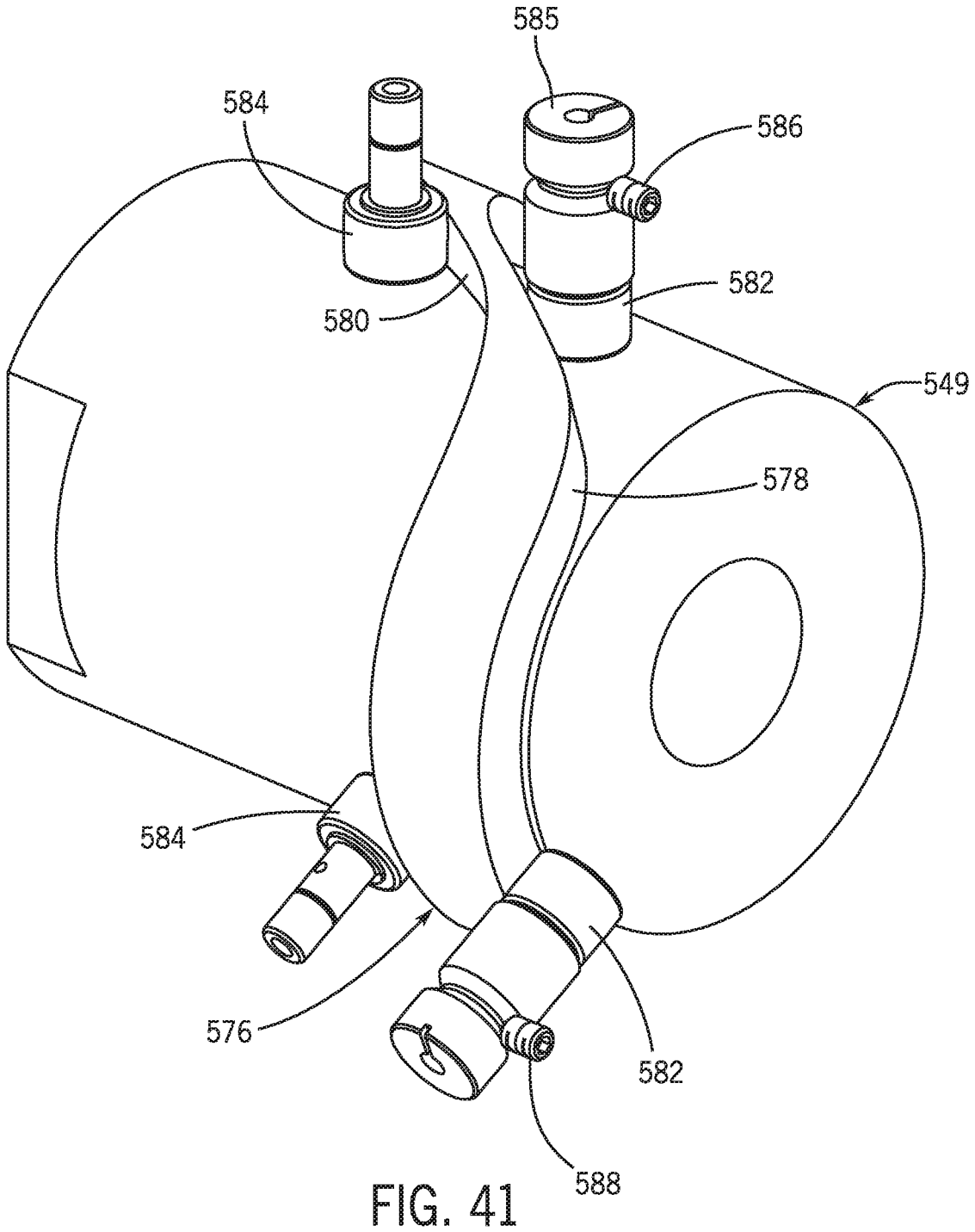
FIG. 41 is a top perspective view of a cam and two sets of cam followers of the cutting device shown in FIG. 37.
Figure 42:
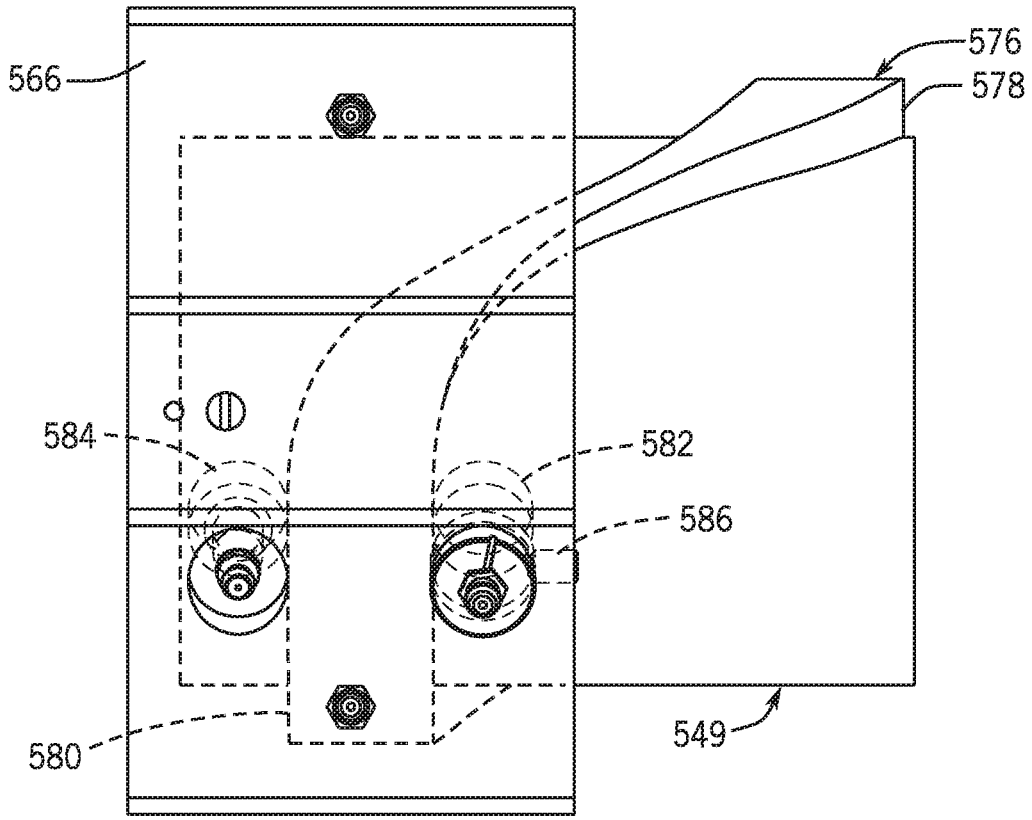
FIG. 42 is a top plan view of the cutting device shown in FIG. 37, with some elements removed for clarity.
Figure 43:
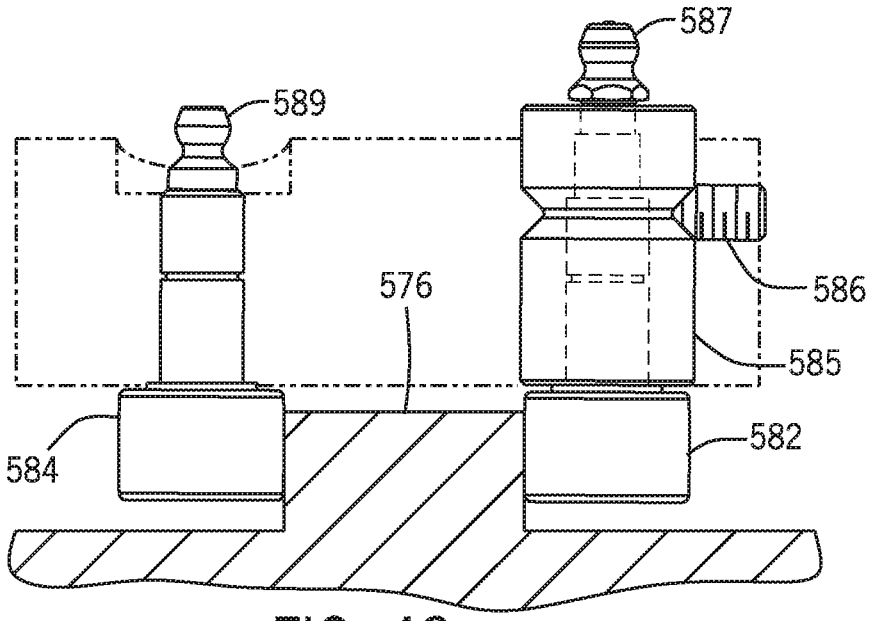
FIG. 43 is an enlarged detail view of the cam and one set of the cam followers shown in FIG. 41 with the cam partially cut away.

Referring now mainly to FIGS. 41-43, each blade assembly 544 includes at least one cam follower. In the present embodiment, a rib 576 having a first rib face 578 and oppositely facing second rib face 580 is defined along the surface of the cam 549. In this embodiment, the blade assembly 544 includes a first cam follower 582, connected to the blade carriage 566 and bearing on the first rib face 578, and a second cam follower 584, connected to the blade carriage 566 and bearing on the second rib face 580. The first and second cam followers 582, 584 are connected to the blade carriage 566 in a manner that permits rotation of the cam followers 582, 584 with respect to the blade carriage 566 when the first and second cam followers 582, 584 are respectively moved along the first and second rib faces 578, 580, that is, as the blade carriage 566 moves along the rib 576. In the present embodiment, the first cam follower 582 is connected to a lash adjuster 585, which is connected to a set screw 586. Adjustment of lash adjuster 585, prior to operation, may be accomplished by rotating the lash adjuster 585 until the first cam follower 582 is brought into contact with the first rib face 578, at which point the adjustment may be fixed in place by tightening the set screw 586. Additionally, a grease fitting 587, for instance, a Zerk fitting, may be attached to the lash adjuster 585, and a similar grease fitting 589 may be attached to the second cam follower 584. Other grease fittings may be employed at other locations of the system 500 where it is desirable to grease a particular element or connection.

As shown best in FIGS. 37-37A, the system 500 further includes an encoder 620 that communicates with the servo motor 600 to establish appropriate accelerations or decelerations of the blade spool 538 rotational speed based on the speed at which the tubing 518 is formed in the winding device 502 and fed through the cutting device 506. The control monitor 508 may include advance and retard controls, which respectively allow the operator to make manual adjustments to the blade spool 538 rotational speed established by the communication between the servo motor 600 and the encoder 620. Additionally, the control monitor 508 may include an emergency stop control 604 and a power control 605. In this embodiment, the emergency stop and power controls 604, 605 are external buttons.

During operation of the system 500, the winding device 502 winds a material into the tubing 518. In this embodiment, the material may be comprised of paper. The tubing 518 is then transferred to the cutting device 506. In this embodiment, the winding device 502 moves the tubing 518 continuously along the angle guide 510, into the funnel 526, and then through the tubing guide 522, where the tubing 518 is cut to a desired straw length.

In this embodiment, the tubing 518 is cut to a desired straw length by rotating the blade 550 of each blade assembly 544 about a central axis of the blade 550 while revolving each blade assembly 544 about the central axis of the blade spool 538, such that each blade 550 is sequentially brought into contact with the tubing 518 when the tubing 518 is moved into a proper position to be cut, and sliding the blade 550 in a direction coinciding with the direction in which the tubing 518 is moving, at least while the tubing 518 is being cut. In the present embodiment, there are three blade assemblies 544, each revolving about the central axis of the blade spool 538 and sequentially cutting a desired straw length of the tubing 518. A commonly desired straw length is approximately 8 inches. However, the system 500 may be calibrated to cut straws of other lengths, as well. The blades 550 are rotated in the same manner and by the same means as shown and described in the first embodiment above, although the rotational direction of the blades may vary as described above.

In the embodiment shown in FIGS. 37-45, each blade assembly 544 is revolved around the central axis of the blade spool 538 through rotation of the spool frame 539, to which each blade assembly 544 is connected. The spool frame 539 is configured in the same way and rotated by the same means as shown and described in the first embodiment, particularly with respect to FIGS. 8-9.

The sliding of the blade 550 is accomplished in this embodiment by the cam followers 582, 584 bearing along the rib 576 as the blade spool 538 rotates. In this embodiment, the first cam follower 582 bears along the first rib face 578, and the second cam follower 584 coincidingly bears along the second rib face 580 as the blade spool 538 rotates and the cam 549 remains stationary with respect to the device frame 520. In the present embodiment, to cut an 8 inch straw, the blade 550 contacts the tubing 518 for a distance of approximately 1.00-1.25 inches as the cut is made. In other embodiments, this distance may vary based on factors such as the desired straw length, the speed with which tubing 518 moves through the tubing guide 522, the rotational speed of the blade spool 538 and blades 550, etc. The sliding of the blade 550 as the blade 550 cuts through the tubing 518 allows the blade 550 to make a clean cut without the need to stop the movement of the tubing 518 through the tubing guide 522 and/or the rotation of the blade spool 538.

Finally, the cutting of the tubing 518 with the blade 550 may produce waste, such as dust and tubing material clippings. According to certain embodiments, a source of vacuum, such as a vacuum hose, connected to the waste chute 552 may draw such waste through the waste chute 552 and out of the cutting device 506. The direction in which the waste is substantially dispelled may vary depending on the rotational direction of the blade 550. For instance, in an embodiment in which the blade 550 is rotated in a forward direction, the waste may be substantially dispelled in a downward direction. In such an embodiment, it may be beneficial to remove the waste from below the cutting location, as shown in the embodiments illustrated in FIGS. 1-7 and FIGS. 21-24. Alternatively, in an embodiment in which the blade 550 is rotated in a rearward direction, the waste may be substantially dispelled in an upward direction. In such an embodiment, it may be beneficial to remove the waste from above the cutting location, as shown in the present embodiment. It has been found that, when revolving the blade spool in a forward direction, rotating the blade in a rearward direction can produce a cleaner cut, compared to rotating both the blade spool and the blade in a forward direction. In addition, to further streamline the waste removal process and improve the flow of air carrying the waste out of the cutting device 506, particularly when the waste is upwardly removed, a waste hood 622 may be utilized, extending into the cutting device frame 520.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A device for cutting straws, the device comprising:
- a cutting device frame;
- a tubing guide connected to the cutting device frame and configured to receive tubing and guide the tubing into a position to be cut;
- a blade spool having a spool central axis, the blade spool comprising:
  - a spool frame connected to the cutting device frame, the spool frame configured to rotate with respect to the cutting device frame about the spool central axis; and
  - a blade assembly, comprising:
    - a blade shaft connected to the spool frame, the blade shaft having a blade shaft central axis spaced apart from and parallel to the spool central axis; and
    - a blade connected to the blade shaft and configured to rotate about the blade shaft central axis and to move through the tubing when the tubing is in the position to be cut;
- a spool driven pulley connected to the spool frame,
- a first driving pulley connected to and configured to be rotated by a servo motor and spaced apart from the spool driven pulley, the servo motor configured to rotate the spool frame about the spool central axis;
- a first timing belt secured about at least the spool driven pulley and the first driving pulley; and
- a blade drive motor connected to the blade shaft and configured to rotate the blade shaft about the blade shaft central axis,
- wherein the blade is connected to the blade shaft in a manner such that the rotation of the blade shaft about the blade shaft central axis rotates the blade about the blade shaft central axis.

2. The device of claim 1, further comprising a second driving pulley connected to and configured to be rotated by the blade drive motor, and wherein the blade spool further comprises a blade shaft driven pulley spaced apart from the second driving pulley, the blade shaft driven pulley connected to the blade shaft and configured to rotate the blade shaft about the blade shaft central axis, and a second timing belt secured about at least the blade shaft driven pulley and the second driving pulley.

3. The device of claim 2, wherein the spool frame further comprises a first spool sidewall, a second spool sidewall parallel to and spaced apart from the first spool sidewall, and a plurality of guide rods extending between the first spool sidewall and the second spool sidewall, and wherein the blade assembly further comprises a blade carriage slidably connected to at least one of the plurality of guide rods and connected to the spindle in a manner that permits free rotation of the spindle with respect to the blade carriage.

4. The device of claim 3, further comprising a fixed axle coaxial with the spool central axis and a cam having a cam surface, the fixed axle affixed to the cutting device frame, and the cam affixed to the fixed axle, and wherein the blade assembly further comprises a first cam follower connected to the blade carriage and positioned, at least in part, in contact with the cam surface.

5. The device of claim 4, wherein the cam surface comprises a rib having a first rib face and an opposing second rib face, the first cam follower positioned, at least in part, in contact with the first rib face, and wherein the blade assembly further comprises a second cam follower connected to the blade carriage and positioned, at least in part, in contact with the second rib face.

6. The device of claim 1, wherein the blade spool further comprises a second blade assembly comprising a second blade shaft connected to the spool frame, the second blade shaft having a second blade shaft central axis spaced apart from and parallel to the spool central axis, and a second blade connected to the second blade shaft and configured to rotate about the second blade shaft central axis and to move through the tubing when the tubing is in a second position to be cut.

7. The device of claim 6, wherein the blade spool further comprises a third blade assembly comprising a third blade shaft connected to the spool frame, the third blade shaft having a third blade shaft central axis spaced apart from and parallel to the spool central axis, and a third blade connected to the third blade shaft and configured to rotate about the third blade shaft central axis and to move through the tubing when the tubing is in a third position to be cut.

8. A device for cutting paper straws, the device comprising:
- a frame;
- a tubing guide connected to and positioned at least in part within the frame, the tubing guide configured to receive tubing and guide the tubing into a position to be cut;
- a fixed axle, secured to and positioned at least in part within the frame;
- a barrel cam mounted to the fixed axle, the barrel cam having a rib including a first rib face and an opposing second rib face;

a blade spool connected to and positioned at least in part within the frame, the blade spool comprising:

a first spool sidewall normally and rotatably connected to the fixed axle, the first spool sidewall comprising a spool driven pulley configured to rotate the blade spool about the fixed axle;

a second spool sidewall normally and rotatably connected to the fixed axle, the second spool sidewall spaced apart from the first spool sidewall; and a plurality of guide rods connecting the first spool sidewall to the second spool sidewall; and a blade assembly, comprising:

a blade shaft having a blade shaft central axis, the blade shaft normally connected to the second spool sidewall;

a blade shaft driven pulley connected to and configured to rotate the blade shaft about the blade shaft central axis;

a spindle slidably connected to the blade shaft in a manner fixed against rotation with respect to the blade shaft;

a first bushing slidably connected to one of the plurality of guide rods;

a blade carriage connected to the first bushing and to the spindle in a manner that permits free rotation of the spindle with respect to the blade carriage;

a blade mounted to the spindle in a manner fixed against rotation with respect to the spindle;

a first cam follower connected to the blade carriage in a manner such that the first cam follower is free to rotate with respect to the blade carriage and positioned, at least in part, in contact with the first rib face; and a second cam follower connected to the blade carriage in a manner such that the second cam follower is free to rotate with respect to the blade carriage and positioned, at least in part, in contact with the second rib face;

a first timing belt secured about at least the spool driven pulley;

a first driving pulley spaced apart from the spool driven pulley and configured to apply a first force to the first timing belt, the first force sufficient to rotate the spool driven pulley;

a servo motor connected to and configured to rotate the first driving pulley;

a second timing belt secured about at least the blade shaft driven pulley;

a second driving pulley spaced apart from the blade shaft driven pulley and configured to apply a second force to the second timing belt, the second force sufficient to rotate the blade shaft driven pulley; and a blade drive motor connected to and configured to rotate the second driving pulley.

9. The device of claim 8, wherein the blade assembly comprises a second bushing connected to another one of the plurality of guide rods, and wherein the blade carriage is secured to the first bushing, to the second bushing, and to the spindle, such that the spindle is free to rotate with respect to the blade carriage.

10. The device of claim 8, wherein the frame further comprises a plurality of interconnected frame panels, at least one of the plurality of interconnected frame panels configured to move between an open position, permitting operator access to the blade spool, and a closed position, preventing operator access to the blade spool, and at least one of the plurality of interconnected frame panels forming a waste opening, and further comprising a waste chute connected to the waste opening, the waste chute configured to connect to a source of vacuum.

* * * * *